US006928790B2

(12) United States Patent
Takahashi et al.

(10) Patent No.: US 6,928,790 B2
(45) Date of Patent: Aug. 16, 2005

(54) MEDICATION FILLING APPARATUS

(75) Inventors: Hideyuki Takahashi, Ota (JP); Hitoshi Ishiwatari, Tatebayashi (JP); Manabu Haraguchi, Gunma (JP); Toshihiko Ota, Ota (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 10/895,100

(22) Filed: Jul. 21, 2004

(65) Prior Publication Data

US 2004/0261357 A1 Dec. 30, 2004

Related U.S. Application Data

(62) Division of application No. 09/856,497, filed on Sep. 24, 2001, now Pat. No. 6,792,736, which is a continuation of application No. PCT/JP00/07832, filed on Nov. 8, 2000.

(30) Foreign Application Priority Data

Nov. 9, 1999 (JP) ..... 11-318906
Nov. 9, 1999 (JP) ..... 11-318909
Nov. 9, 1999 (JP) ..... 11-318912

(51) Int. Cl.[7] ..... B65B 5/00

(52) U.S. Cl. ..... 53/247; 53/52; 53/238; 221/251; 221/258

(58) Field of Search ..... 53/154, 237, 238, 53/247, 493, 52; 221/130, 133, 251, 255, 256, 257, 258

(56) References Cited

U.S. PATENT DOCUMENTS 5,348,061 A 9/1994 Riley et al.
5,667,096 A 9/1997 Wu
5,678,393 A 10/1997 Yuyama et al.
5,709,063 A 1/1998 Yuyama et al.
5,752,368 A 5/1998 Tobe
5,765,606 A 6/1998 Takemasa et al.
5,787,678 A 8/1998 Koike et al.
5,852,911 A 12/1998 Yuyama et al.
5,865,342 A 2/1999 Ito et al.
6,170,699 B1 1/2001 Kim
6,208,911 B1 3/2001 Yamaoka et al.
6,481,180 B1 * 11/2002 Takahashi et al. ..... 53/237
6,792,736 B1 * 9/2004 Takahashi et al. ..... 53/237

FOREIGN PATENT DOCUMENTS

| | | |
|---|---|---|
| EP | 0 719 537 | 7/1996 |
| EP | 0 850 633 | 7/1998 |
| JP | 59-203561 | 11/1984 |
| JP | 10-118160 | 5/1998 |
| JP | 11-206854 | 8/1999 |

* cited by examiner

*Primary Examiner*—Louis Huynh
(74) *Attorney, Agent, or Firm*—Armstrong, Kratz, Quintos, Hanson & Brooks, LLP

(57) ABSTRACT

A medication filling apparatus for filling a predetermined container with medications, such as tablets, provide improved assemblability and maintainability, and permits safe and reliable filling operations, while maintaining a compact size. The medication filling apparatus is equipped with a plurality of tablet cases for accommodating medications of respective types, a plurality of hoppers provided side by side below the respective tablet cases in a corresponding manner to receive the medications dispensed therefrom, and charging means for guiding the medications dispensed from a dispensing port formed at the bottommost portion of each hopper to a predetermined container and for charging them, and is further equipped with retaining members on which the hoppers are hung, wherein the hoppers are detachably installed to the retaining members.

4 Claims, 29 Drawing Sheets

MEDICATION FILLING APPARATUS

This application is a divisional application of U.S. application Ser. No. 09/856,497, filed Sep. 24, 2001, now U.S. Pat. No. 6,792,736, which is a continuation of International Application No. PCT/JP00/07832, filed Nov. 8, 2000.

TECHNICAL FIELD

The present invention relates to a medication filling apparatus for filling a container with medications (hereinafter referred to all solidified medications, such as tablets, capsules, pills, and lozenges) specified by prescriptions at hospitals or the like.

BACKGROUND ART

Hitherto, at a hospital, a plurality of types of medications prescribed by doctors are separately packaged for each dosage by using a tablet packaging machine disclosed in, for example, Japanese Examined Patent Publication No. 3-59 (A61J3/00), then supplied to patients. However, such a separately packaging system is adapted to dispense tablets for each dosage and collect them by a hopper or a conveyor or the like before packaging them, thus requiring a long time to complete the packaging, including the time for waiting the tablets to be collected. Furthermore, the tablets are collected by such a hopper or a conveyor or the like, solely depending on the gravity, so that the entire apparatus has inevitably been bulky.

This is also a medication filling apparatus adapted to charge each type of prescribed tablets in a container, such as a bottle (or a bag) to supply them to patients. In the case of such a tablet filling apparatus, a construction has conventionally been employed in which a plurality of tablet cases accommodating respective types of tablets are arranged like lockers so that they are tilted low forward, and each tablet case is provided with a dispensing mechanism for dispensing the tablets from the tablet case to thereby dispense the tablets in a tablet case designated according to a prescription by the dispensing mechanism.

In such a tablet filling apparatus, since tablets are not separately packaged for each dosage, the tablets can be charged more quickly than in the tablet packaging machine described above. However, an operator must hold a container and go to the front of a proper tablet case to fill a container with tablets from the dispensing mechanism. Hence, if there are many types of tablets, in particular, it has been extremely complicated and time-consuming to fill different types of containers.

Furthermore, since the plurality of tablet cases are arranged like lockers against a wall surface, it has been impossible to achieve a reduction in size of an entire apparatus that has been required of a conventional tablet packaging machine.

Therefore, the applicant has developed a structure in which a rotary plate is provided under a plurality of tablet cases arranged side by side, a plurality of accommodating portions are formed in the rotary plate, a tablet dispensed from a tablet case is received and held in a predetermined accommodating portion associated with the tablet case and located below the tablet case by the rotation of the rotary plate, and then the tablet is charged in a container from an outlet, as disclosed in Japanese Unexamined Patent Publication No. 10-192367.

According to the construction, tablets can be charged at one location, and the vertical dimension of an entire apparatus can be reduced, as compared with a conventional conveyor type or a locker type apparatus; however, tablets are prone to jump into another accommodating portion through a clearance (gap) formed around the periphery of the rotary plate when the rotary plate rotates, leading to a possibility of mixture of different types of medications.

In addition, the clearance between the rotary plate and its peripheral member must be closely specified in designing and manufacture to prevent the above, posing a problem in that the productivity is deteriorated and the cost is increased.

The present invention has been made with a view toward solving the conventional technological problems, and it is an object thereof to improve the ease of installation and maintenance and to permit a safe and reliable filling operation, while maintaining a small size in a medication filling apparatus for filling a predetermined container with medications, such as tablets.

DISCLOSURE OF INVENTION

The present invention is characterized in that, in a medication filling apparatus equipped with a plurality of tablet cases for accommodating medications of respective types, a plurality of hoppers provided side by side below the respective tablet cases in a corresponding manner to receive the medications dispensed therefrom, and charging means for guiding the medications dispensed from an outlet formed at the bottommost portion of each hopper to a predetermined container and for charging them, a retaining member for hanging each hopper is provided, each hopper being detachably installed to the retaining member.

According to the present invention, medications are dispensed from the tablet cases accommodating the medications of respective types, and the medications dispensed from the tablets cases are received by the plurality of hoppers arranged thereunder side by side. Hence, the vertical dimension of the apparatus can be reduced while maintaining the tilt angles of the hoppers that allow the medications to fall.

In particular, since the hoppers are detachably installed to the retaining members, the ease of the installation and the ease of the maintenance, such as cleaning, of the hoppers to which chips or dust of medications are prone to stick can be significantly improved, thus making it possible to effectively prevent an inconvenience in that the dust or chips of other medications are mixed in.

In addition to the above, the present invention is characterized by the provision of hopper detecting means for detecting that the hoppers have been installed to the retaining members. With this arrangement, when the hoppers are removed for maintenance or the like, whether the hoppers have been reinstalled or not can be detected by the hopper detecting means. Thus, if there is a possibility of erroneous charging with the hoppers removed, then the operation of the apparatus, for example, can be inhibited or an alarm can be issued to thereby avoid such an inconvenience.

In addition, the present invention is characterized by the provision of a height adjusting mechanism for adjusting the height of the outlet of each hopper. With this arrangement, the clearance between the outlet of each hopper and the charging means can be adjusted to an optimum value, permitting prevention of an inconvenience in which the medications discharged from outlets jump out of the charging means. Moreover, if, for example, the charging means is constructed of a movable member, then it is also possible to avoid an inconvenience in which the hoppers interfere with the operation of the charging means.

Furthermore, the present invention is characterized in that, in a medication filling apparatus equipped with a plurality of tablet cases for accommodating medications of respective types, a plurality of hoppers provided side by side below the respective tablet cases in a corresponding manner to receive the medications dispensed therefrom, and charging means for guiding the medications dispensed from an outlet formed at the bottommost portion of each hopper to a predetermined container and for charging them, each hopper is provided with a vertical wall installed in a standing manner to partition the interior thereof.

According to the present invention, medications are dispensed from the tablet cases accommodating the medications of respective types, and the medications dispensed from the tablets cases are received by the plurality of hoppers arranged thereunder side by side. Hence, the vertical dimension of the apparatus can be reduced while maintaining the tilt angles of the hoppers that allow the medications to fall.

In particular, since each hopper is provided with the vertical wall for partitioning the interior thereof that is installed in a standing manner, it is possible to quickly end an inconvenience in which the medications that have fallen into the hoppers jump around in the hoppers. This allows the medications that have fallen into the hoppers to be quickly retained and stored onto the bottoms in the hoppers, permitting a reduction in the time required for charging medications.

Moreover, the present invention is characterized in that, in a medication filling apparatus equipped with a plurality of tablet cases for accommodating medications of respective types, a plurality of hoppers provided side by side below the respective tablet cases in a corresponding manner to receive the medications dispensed therefrom, and charging means for guiding the medications dispensed from an outlet formed at the bottommost portion of each hopper to a predetermined container and for charging them, each hopper is provided with an anti-spilling wall that extends outward from the outlet and is installed over the full periphery of the outlet.

According to the present invention, medications are dispensed by a controller from the tablet cases accommodating the medications of respective types, and the medications dispensed from the tablets cases are received by the plurality of hoppers arranged thereunder side by side. Hence, the vertical dimension of the apparatus can be reduced while maintaining the tilt angles of the hoppers that allow the medications to fall.

In particular, since each hopper is provided with the anti-spilling wall extends outward from the outlet and is installed over the full periphery of the outlet, even if a medication that has been dispensed from the outlet of each hopper and entered the charging means bounces and attempts to jump out through the clearance between the outlet of the hopper and the charging means, the medication can be bounced back toward the charging means by the anti-spilling wall. This makes it possible to securely prevent such an inconvenience in which medications that have come out from the outlets jump out of the charging means.

Furthermore, the present invention is characterized in that, in a medication filling apparatus equipped with a plurality of tablet cases for accommodating medications of respective types, a plurality of hoppers provided side by side below the respective tablet cases in a corresponding manner to receive the medications dispensed therefrom, outlets respectively formed at the bottommost portions of the hoppers, a plurality of holding cells that are disposed below the hoppers and are rotationally moved on the circumferences where the outlets of the hoppers exist, shutters for opening and closing the lower end outlets of the holding cells, and charging means for guiding the medications dispensed from the holding cells to a predetermined container and for charging them, wherein, when a medication is dispensed from a tablet case, a holding cell is rotationally moved to adjust its position thereby to align the upper end inlet of the holding cell to the outlet of the hopper that receives the dispensed medication so as to accommodate the medication falling from the tablet case in a predetermined holding cell, and when filling a container, the holding cell is rotationally moved to align its outlet to the charging means before a shutter is opened; the holding cell is constructed by a fixed cell and a movable cell installed such that it can move in a direction for opening the outlet in relation to the fixed cell, and the movable cell is moved in a direction for opening the outlet by movable cell driving means to open the shutter.

According to the present invention, medications are dispensed from the tablet cases accommodating the medications of respective types, and the medications dispensed from the tablets cases are received by the plurality of hoppers arranged thereunder side by side. Hence, the vertical dimension of the apparatus can be reduced while maintaining the tilt angles of the hoppers that allow the medications to fall. Moreover, since the holding cell is rotationally moved to adjust its position thereby to align the upper end inlet of the holding cell to the outlet of the hopper that receives the dispensed medication, the medication fallen from a tablet case is temporarily accommodated in a predetermined holding cell. Then, to charge the medication in a container, the holding cell is rotationally moved to align its outlet to the charging means, and the shutter is opened. Hence, the medication in the holding cell is charged in the container by being guided to the container by the charging means from a lower end outlet.

Accordingly, it is possible to charge the medications specified among a plurality of types in respective containers by the charging means at a single location, leading to markedly improved workability. Furthermore, the operation has been realized in which the holding cells are rotationally moved to match their upper end inlets to the outlets of the hoppers and to align the lower end outlets of the holding cells to the charging means. Therefore, the time required for charging can be considerably shortened, so that the waiting time before the medications are supplied to patients can be further shortened, permitting improved service to be achieved.

Moreover, in a case where a plurality of types of medications are charged in succession, for example, the medications can be respectively accommodated in a plurality of holding cells; therefore, parallel processing can be smoothly performed. In particular, mixing of medications can be securely prevented as long as the positioning of the hoppers and the holding cells are accurately performed. This obviates the need for strictly controlling the clearance or the like between a drive component and a peripheral component thereof, allowing a simpler structure and reduced production cost to be achieved, as compared with a prior art.

In particular, in the present invention, the holding cells are constructed of the fixed cells and the movable cells installed-so that they can move in the direction for opening the outlets in relation to the fixed cells, and the movable cells are moved in the direction for opening the outlets by the movable cell driving means when opening the shutters. Hence, even if medications are stacked and stuck in the holding cells, the stuck medications can be collapsed by moving the movable cells, thus permitting the medications to smoothly fall into the charging means. Thus, the time required for charging can be further shortened and a reliable charging operation can be realized.

In addition to the above, the present invention is characterized by the provision of a movable cell operation detecting means for detecting the operation of the movable cell. With this arrangement, if a problem arises in the movement of the movable cells due to a failure of the movable cell driving means or other member, then it will be possible to detect it, and to inhibit, for example, the operation of an apparatus or issue an alarm.

Furthermore, in addition to the above, the movable cell driving means in the present invention is disposed such that it disengageably engages the movable cell of the holding cell that matches the charging means, without interfering with the rotational movement of the holding cell.

With this arrangement, only a single movable cell driving means for moving the movable cells of a plurality of holding cells is required, permitting a marked reduction in the number of components, as compared with a case where each holding cell is provided with a driving means.

Furthermore, the present invention is characterized in that, in a medication filling apparatus equipped with a plurality of tablet cases for accommodating medications of respective types, a plurality of hoppers provided side by side below the respective tablet cases in a corresponding manner to receive the medications dispensed therefrom, outlets respectively formed at the bottommost portions of the hoppers, a plurality of holding cells that are disposed below the hoppers and are rotationally moved on the circumferences where the outlets of the hoppers exist, shutters for opening and closing the lower end outlets of the holding cells, and charging means for guiding the medications dispensed from the holding cells to a predetermined container and for charging them, wherein, when a medication is dispensed from a tablet case, a holding cell is rotationally moved to adjust its position thereby to align the upper end inlet of the holding cell to the outlet of the hopper that receives the dispensed medication so as to accommodate the medication falling from the tablet case in a predetermined holding cell, and when filling a container, the holding cell is rotationally moved to align its outlet to the charging means before a shutter is opened; a holding unit is constructed by a holding cell and a shutter, and a plurality of the holding units are installed on a rotating plate that rotates below the hoppers.

According to the present invention, medications are dispensed from the tablet cases accommodating the medications of respective types, and the medications dispensed from the tablets cases are received by the plurality of hoppers arranged thereunder side by side. Hence, the vertical dimension of the apparatus can be reduced while maintaining the tilt angles of the hoppers that allow the medications to fall. Moreover, since the holding cell is rotationally moved to adjust its position thereby to align the upper end inlet of the holding cell to the outlet of the hopper that receives the dispensed medication, the medication fallen from a tablet case is temporarily accommodated in a predetermined holding cell. Then, to charge the medication in a container, the holding cell is rotationally moved to align its outlet to the charging means, and the shutter is opened. Hence, the medication in the holding cell is charged in the container by being guided to the container by the charging means from a lower end outlet.

Accordingly, it is possible to charge the medications specified among a plurality of types in respective containers by the charging means at a single location, leading to markedly improved workability. Furthermore, the operation has been realized in which the holding cells are rotationally moved to match their upper end inlets to the outlets of the hopper and to align the lower end outlets of the holding cells to the charging means. Therefore, the time required for charging can be considerably shortened, so that the waiting time before the medications are supplied to patients can be further shortened, permitting improved service to be achieved.

Moreover, in a case where a plurality of types of medications are charged in succession, for example, the medications can be respectively accommodated in a plurality of holding cells; therefore, parallel processing can be smoothly performed. In particular, mixing of medications can be securely prevented as long as the positioning of the hoppers and the holding cells are accurately performed. This obviates the need for strictly controlling the clearance or the like between a drive component and a peripheral component thereof, allowing a simpler structure and reduced production cost to be achieved, as compared with a prior art.

According to the present invention, in particular, each of the holding units is constructed by a holding cell and a shutter, and a plurality of the holding units are installed on the rotating plate that rotates below the hoppers. This arrangement makes it possible to reduce the time and efforts for installing the holding cells or shutters, thereby achieving marked improvement in assemblability.

Furthermore, in addition to the above, the present invention is characterized in that the shutter driving means for opening and closing the shutters is disposed such that it does not interfere with the rotating motion of the holding units by the rotation of the rotating plate and that it detachably engages with the shutter of the holding unit whose holding cell matches the charging means.

With such an arrangement, only one shutter driving means is required for opening and closing the shutters of the plurality of holding units, making possible to significantly reduce the number of components, as compared with a case where the driving means is provided for each of the respective holding units.

Moreover, in addition to the above, the present invention is characterized by the provision of a shutter opening/closing detecting means for detecting the opening and closing of the shutters.

With such an arrangement, if an opening or closing failure of the shutters takes place due to a failure of the shutter driving means or other components, it is possible to detect the failure and, for example, to inhibit the operation of the apparatus or issue an alarm.

BEST MODE FOR CARRYING OUT THE INVENTION

Figure 1:
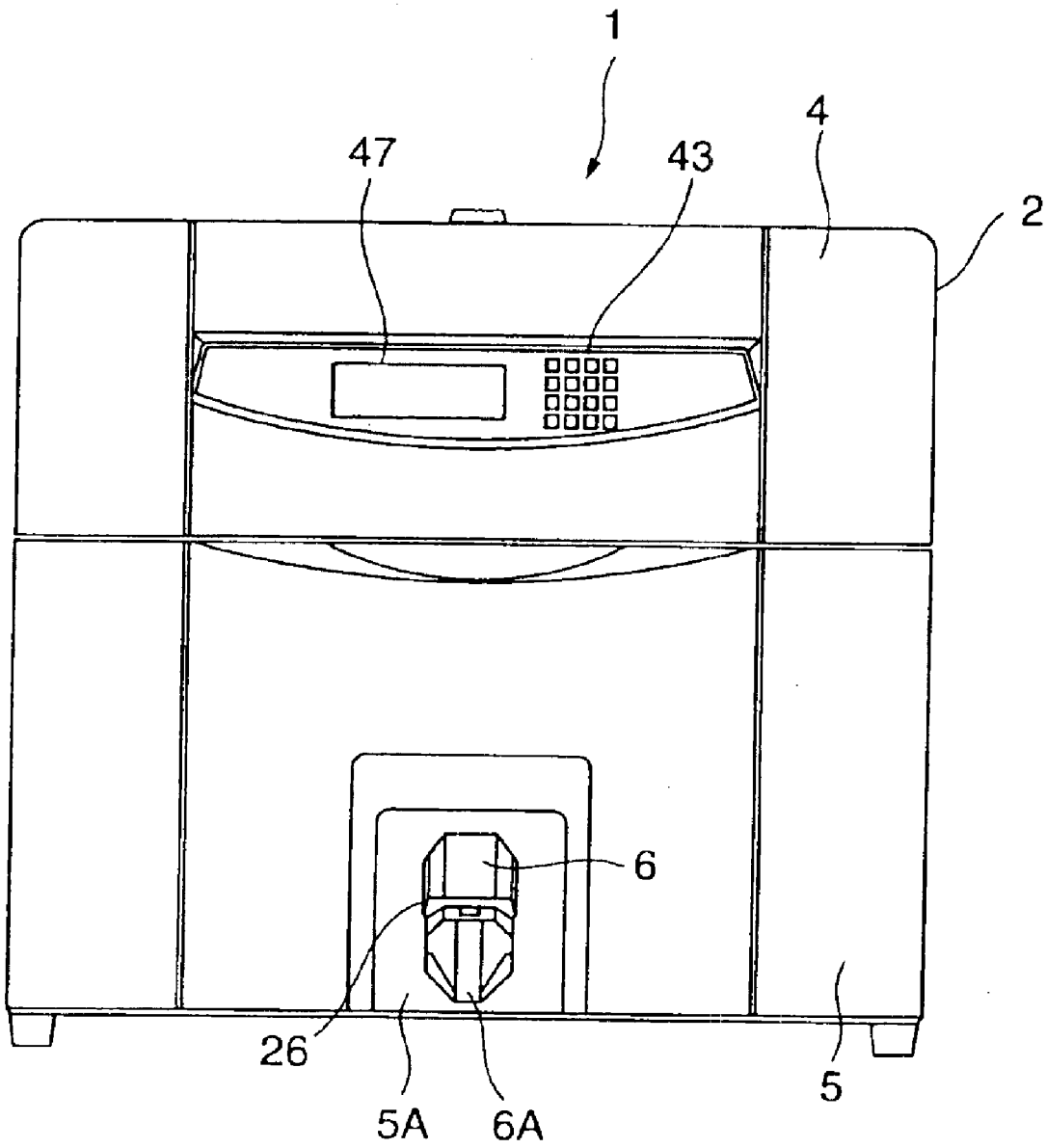
FIG. 1 is a front view of a medication filling apparatus in accordance with the present invention.
Figure 2:
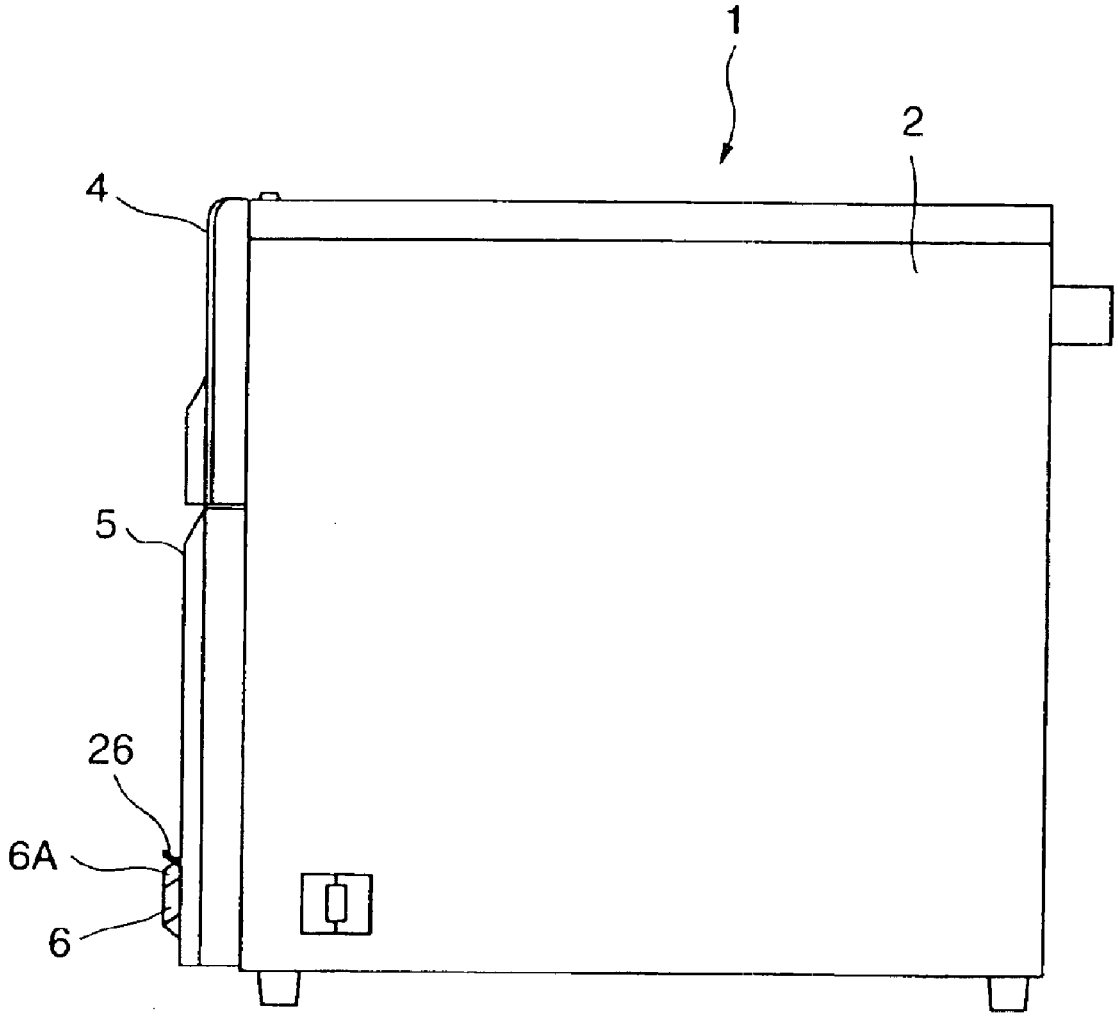
FIG. 2 is a side view of the medication filling apparatus in accordance with the present invention.
Figure 3:
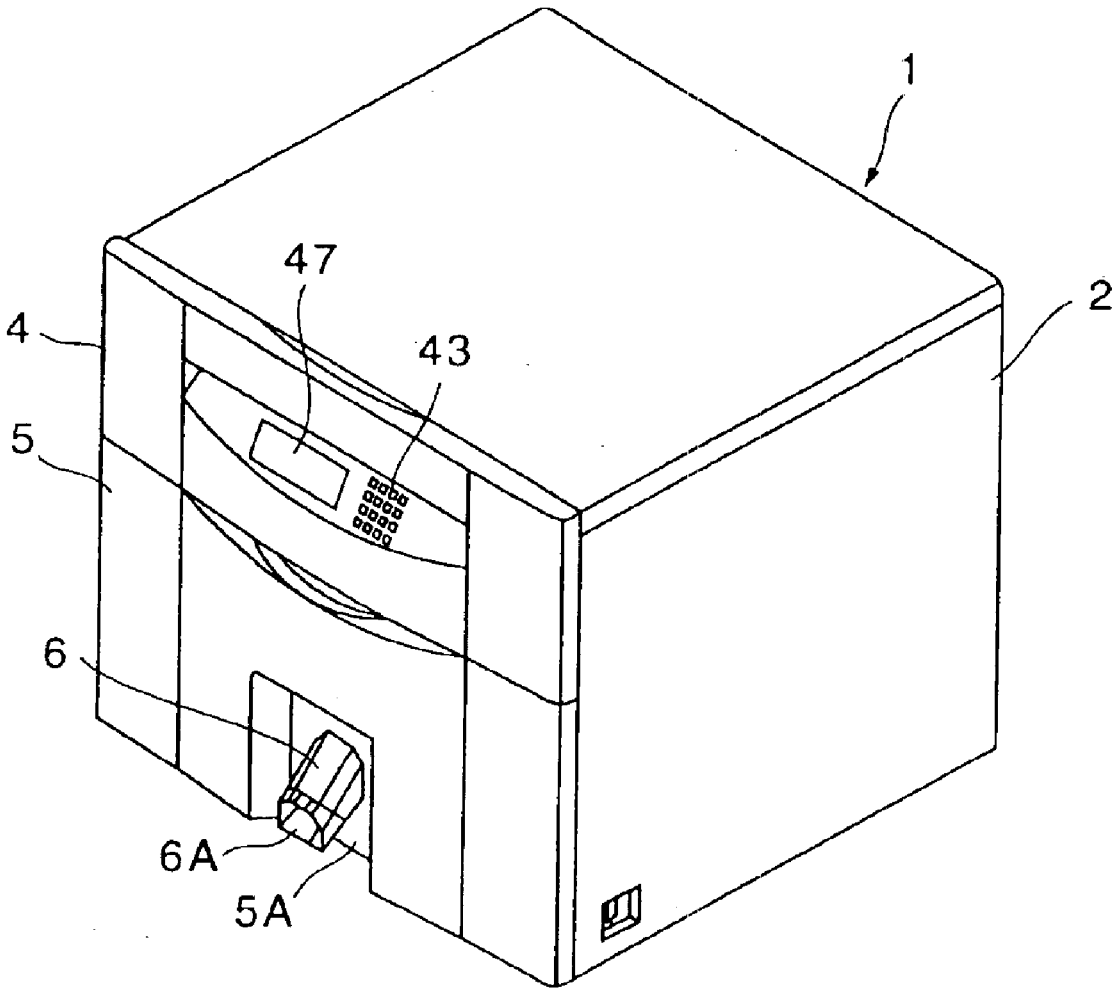
FIG. 3 is a perspective view of the medication filling apparatus in accordance with the present invention.

An embodiment according to the present invention will now be described in detail in conjunction with the accompanying drawings.

A medication filling apparatus 1 in accordance with the present invention is installed at a hospital or a dispensing pharmacy, and is constituted by a medication accommodating portion 3 formed in a rectangular main body 2, a medication filling mechanism 10 provided thereunder, etc. The medication accommodating portion 3 is constructed at the upper portion in the main body 2, and the front surface of the medication accommodating portion 3 is closed by an upper door 4, which is free to circularly move down forward, such that it can be opened and closed. The front surface of the medication filling mechanism 10 is closed such that it can be opened and closed by a lower door 5 that can be drawn out (drawer type) by a rail 59. The medication filling mechanism 10 can be drawn out together with the lower door 5 from the main body 2.

A filling unit 5A, which is withdrawn slightly inward is formed at the front central part of the lower door 5, and an outlet 6A of a chute 6 making up a filling means is formed in the filling unit 5A. In addition, in the filling unit 5A, a bar code reader 42, which will be discussed hereinafter, is provided in the vicinity of the outlet 6A, and furthermore, a key switch 43 composed of ten keys and a display device 47 displaying the details of prescription data and preparing states, such as alarms, are provided on the front surface of the upper door 4 collateral to the upper side of the filling unit 5A.

A plurality of tablet cases 7 . . . are accommodated in the medication accommodating portion 3. Each of the tablet cases 7 . . . is filled with a predetermined amount of medications of each type, and dispensing counters 8 are provided at the bottoms of the respective tablet cases 7 . . . , as shown in FIG. 36.

Each of the dispensing counter 8 is in communication with the tablet case 7 located thereabove, and incorporates a motor-driven dispensing drum 9 therein. A plurality of grooves 11 are vertically formed in the side surface of the dispensing drum 9, and the medications, which are solidified drug products, including tablets, capsules, pills, and lozenges, enter in one vertical line (two in the embodiment) into each of the grooves 11.

Figure 36:
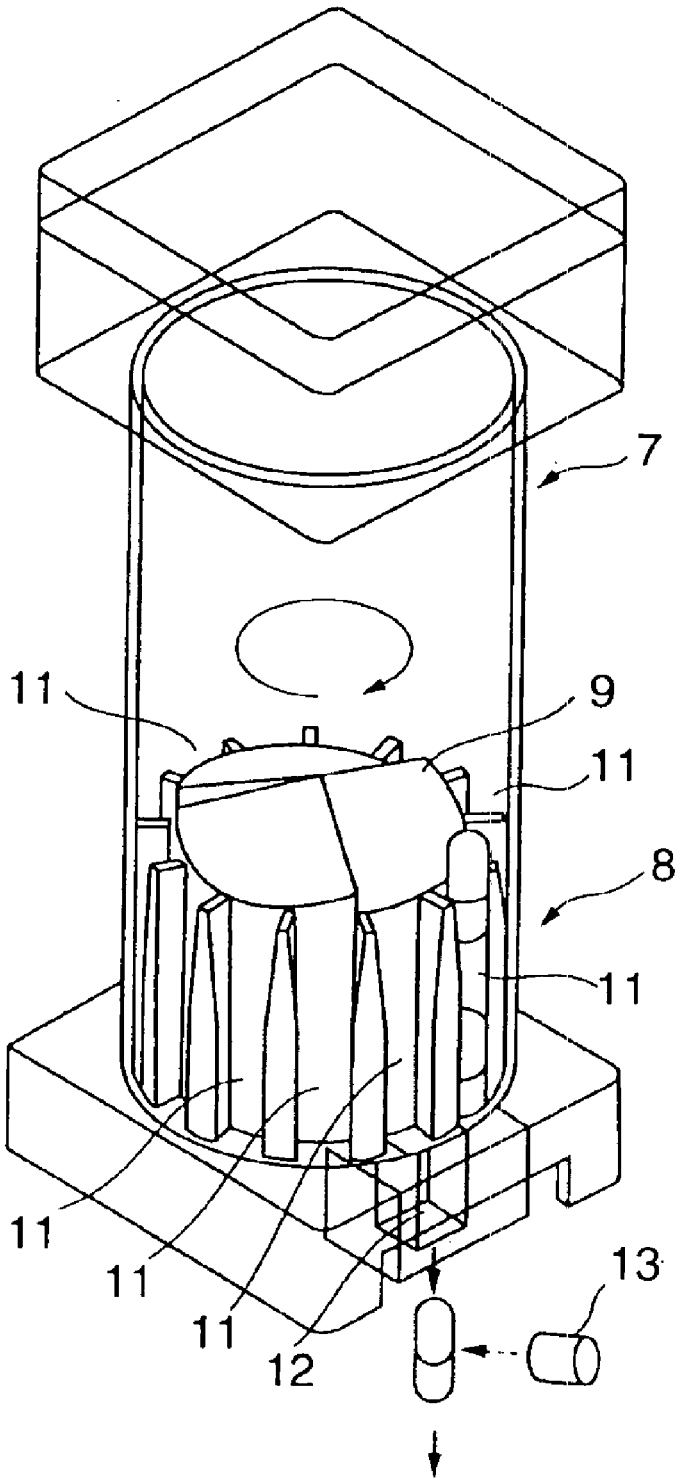
FIG. 36 is a see-through perspective view of a tablet case and a dispensing counter of the medication filling apparatus in accordance with the present invention.

As the dispensing drum 9 rotates, the medications in each groove 11 drops one by one through an outlet 12 (indicated by the black arrows in FIG. 36). Furthermore, the dispensing counter 8 is provided with a photosensor 13 for detecting the medications falling through the outlet 12.

A predetermined number of the tablet cases 7 described above are rested on a rectangular receiving member 50, and a plurality of the receiving members 50 are provided side by side. The receiving members 50 . . . are retained such that they can be drawn out forward and drawn in backward by rails, not shown (refer to FIG. 4).

To supply, for example, medications in the tablet cases 7 . . . , the upper door 4 is opened, and the receiving members 50 are drawn out to move the tablet cases 7 onto the upper door 4. After supplying the medications in the tablet cases 7 . . . , the receiving members 50 are pushed back again to move the tablet cases 7 into the medication accommodating portion 3.

By pulling the tablet cases 7 . . . out forward or in backward, medications can be supplied in the tablet cases 7 or the tablet cases 7 can be replaced without the need for securing a space above the medication filling apparatus 1, thus permitting space saving to be achieved.

The medication filling mechanism 10 is constituted primarily by four hoppers 51, 52, 53, and 54 arranged side by side in the embodiment, a disc-shaped rotating plate 16 on which a plurality of (ten in the embodiment) holding units 61 . . . (making up the filling means) are mounted on the upper surface thereof, and the aforesaid chute 6. The hoppers 51 through 54 are disposed, without any clearance, under the tablet cases 7 . . . , and the rotating plate 16 is rotatably provided under these hoppers 51 through 54.

Figure 6:
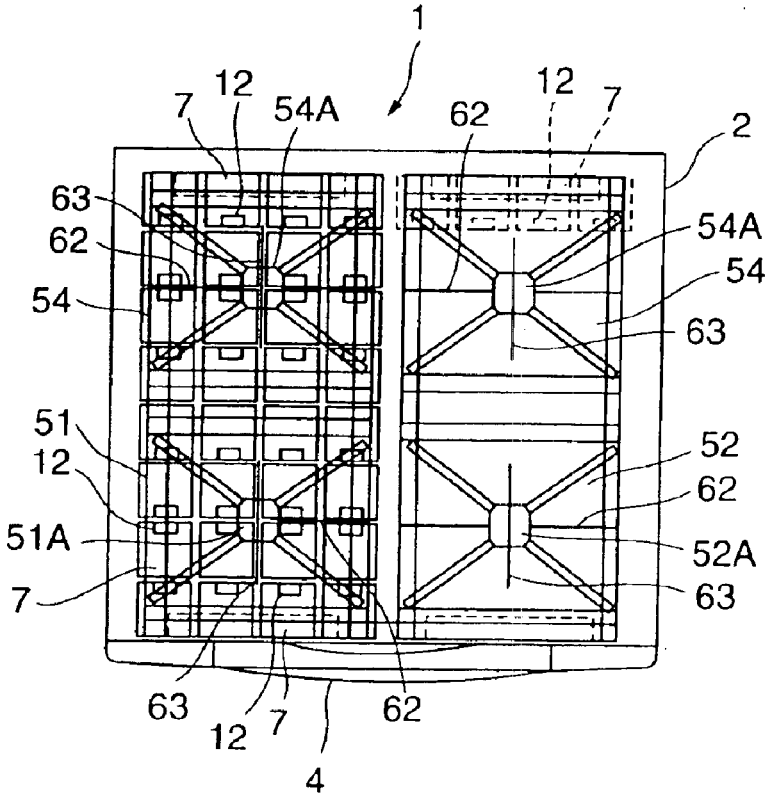
FIG. 6 is a plane cross-sectional view of the medication filling apparatus in accordance with the present invention.
Figure 7:
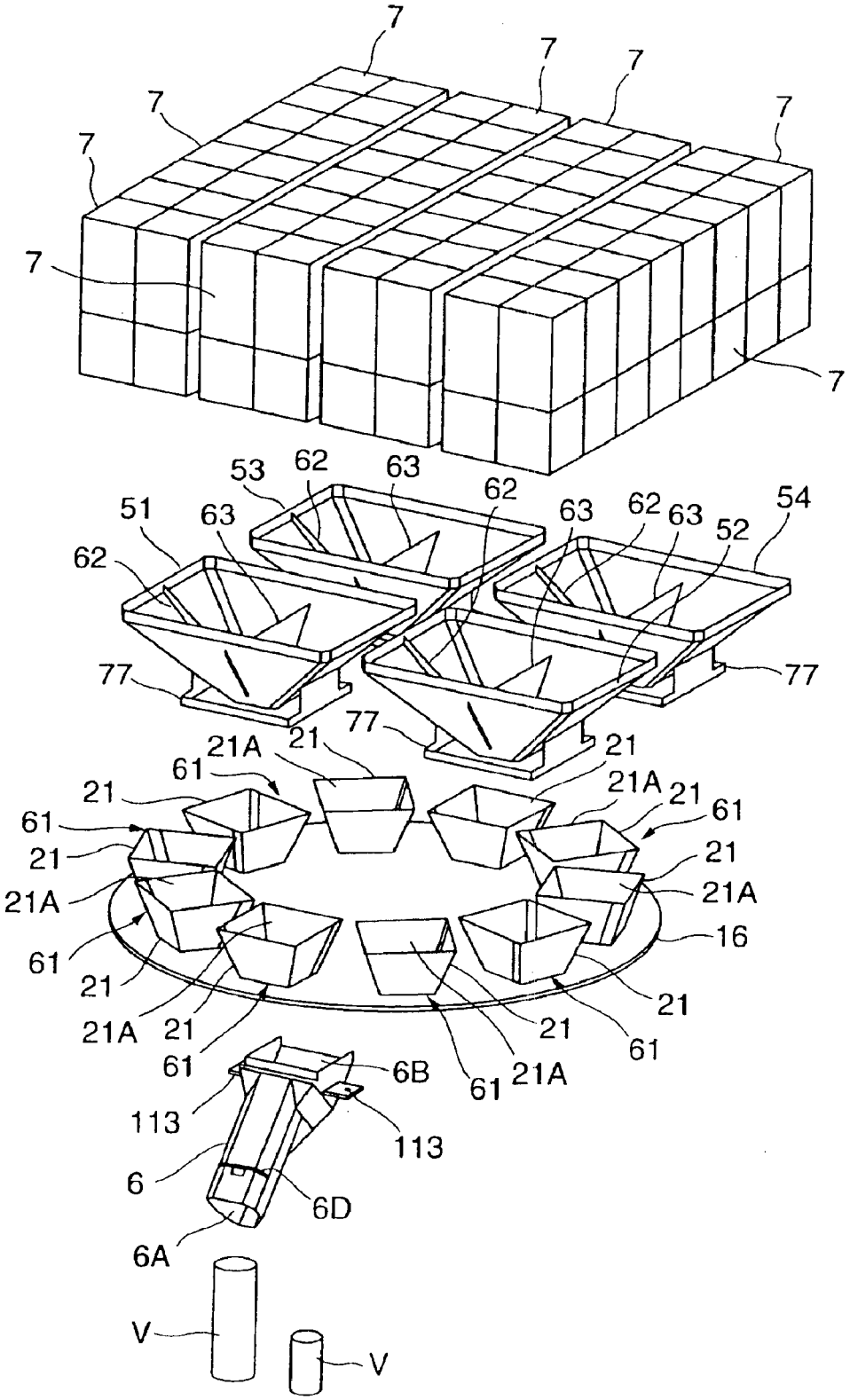
FIG. 7 is a diagram showing the construction of the interior of the medication filling apparatus in accordance with the present invention.

In this case, the tablet cases 7 . . . are arranged in a substantially square pattern in a top plan view, as shown in FIG. 6, and a rotational center 16A of the rotating plate 16 corresponds to the center of the square. All the hoppers 51 through 54 are tapered to have a slope of a predetermined angle from their rectangular upper end openings toward dispensing ports 51A through 54A at their lower ends. The slope is to have a value that is adequate for medications to smoothly fall.

The hoppers 51 and 52 are laterally arranged at the front, while the hoppers 53 and 54 are laterally arranged at the rear thereof, the upper end openings of the hoppers 51 through 54 being placed in close contact with no clearance. The upper side of the hopper 51 at front left is collateral to a total of sixteen tablet cases 7 . . . located at front left among the tablet cases 7 . . . disposed in the square shape as a whole as mentioned above. The upper side of the hopper 52 at front right is collateral to a total of sixteen tablet cases 7 . . . located at front right.

Furthermore, The upper side of the hopper 53 at rear left is collateral to a total of sixteen tablet cases 7 . . . located at rear left, while the upper side of the hopper 54 at rear right is collateral to a total of sixteen tablet cases 7 . . . located at rear right.

With this arrangement, by, for example, accommodating the same medications that are consumed in a large volume in two or more tablet cases 7 collateral to the upper side of the same hopper 51, 52, 53, or 54, it is possible to fill bottles by simultaneously dropping medications from these tablet cases 7 . . . , as it will be discussed hereinafter, allowing the filling time to be shortened (shown in FIG. 6).

Moreover, by disposing the tablet cases 7 . . . filled with the same type of medications above the same hopper 51, 52, 53, or 54, the same hopper can be used exclusively for the same type of medications, thereby preventing the occurrence of an inconvenience caused by the adhesion of powders of different medications to the hoppers.

Figure 8:
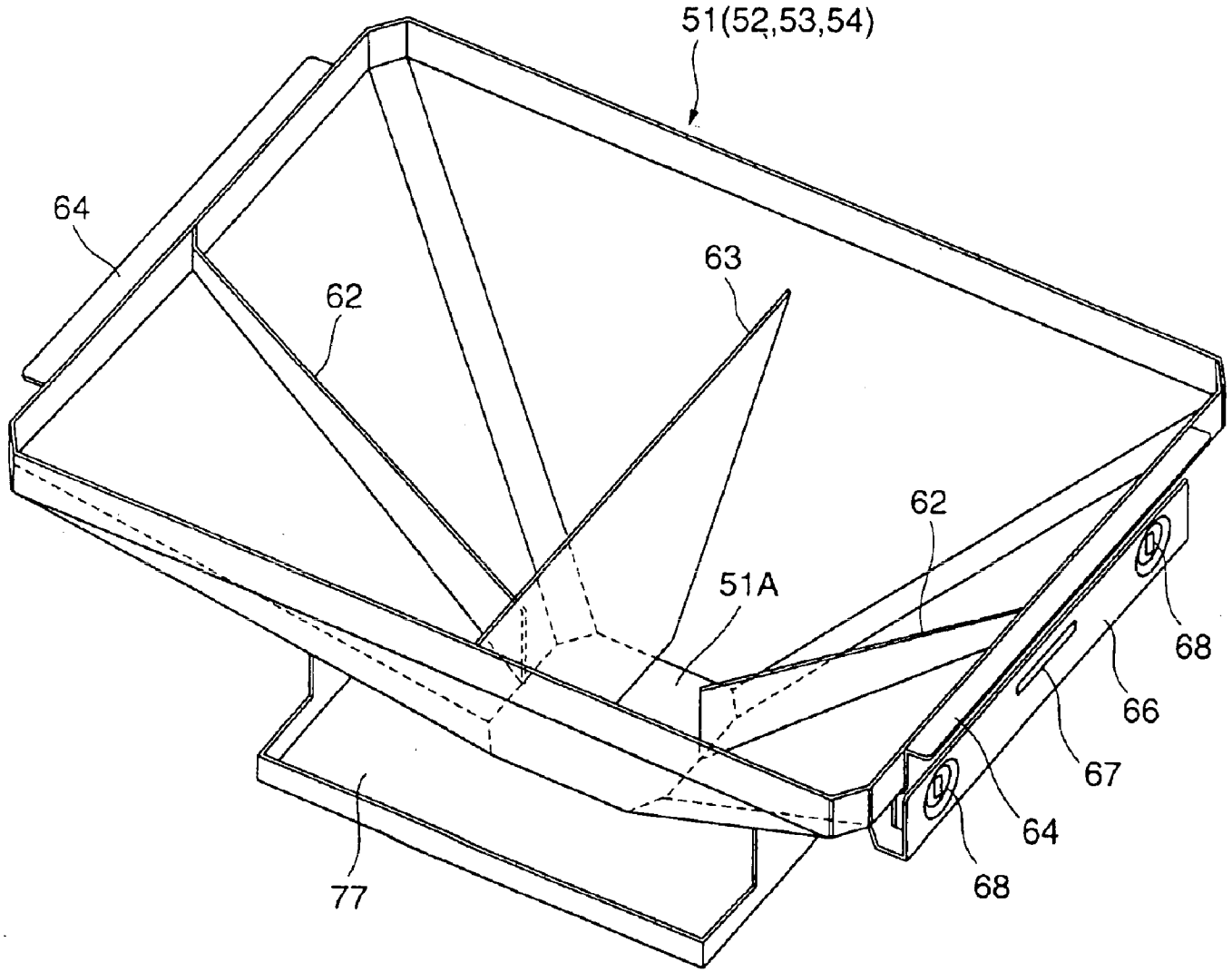
FIG. 8 is a perspective view of a hopper of the medication filling apparatus in accordance with the present invention.

The right and left inner surfaces (slope surfaces) of the hoppers 51 through 54 are provided with vertical walls 62 vertically formed along the inner surfaces, as shown in FIG. 8 (this drawing shows the hopper 51; however, the same applies to the remaining hoppers 52 through 54). A vertical wall 63 is vertically provided so that it extends from front to rear on the inner surfaces across the dispensing port 51A (52A, 53A, or 54A). These vertical walls 62 and 63 are positioned to avoid the locations right under the outlets 12 . . . of the tablet cases 7 . . . , as shown in FIG. 6. The medications that have fallen into the hoppers 51 through 54 from the tablet cases 7 bump against the inner surfaces thereof and bounce back, and attempt to repeat it; however, since the vertical walls 62 and 63 are formed on the inner surfaces of the hoppers 51 through 54, the bounced medications collide with the vertical walls 62 and 63. This causes the rebounding motion of the medications to end quickly in reaching the dispensing ports 51A through 54A.

Furthermore, mounting plates 64 are installed on the outside of the right and left upper edges of each of the hoppers 51 through 54, and substantially L-shaped retaining plates 66 constituting height adjustment mechanisms are attached by screws, which are not shown, to the bottoms of the mounting plates 64. In this case, a slit-shaped engaging hole 67 is formed at the central part of each of the retaining plates 66, and vertically longer slots 68 and 68 are formed on the right and left sides thereof in each of the retaining plates 66. The screws are screwed into the slots 68 and 68 and tapped holes, which are not shown, in each of the mounting plates 64. The heights of the bottom ends of the retaining plates 66 can be adjusted by adjusting the vertical positions of the retaining plates 66 in relation to the tapped holes, within the vertical dimensions of the slots 68 and 68.

Figure 11:
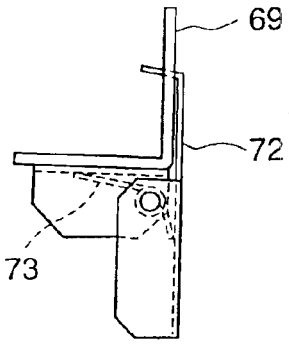
FIG. 11 is an enlarged view of a movable hook of the medication filling apparatus in accordance with the present invention.
Figure 12:
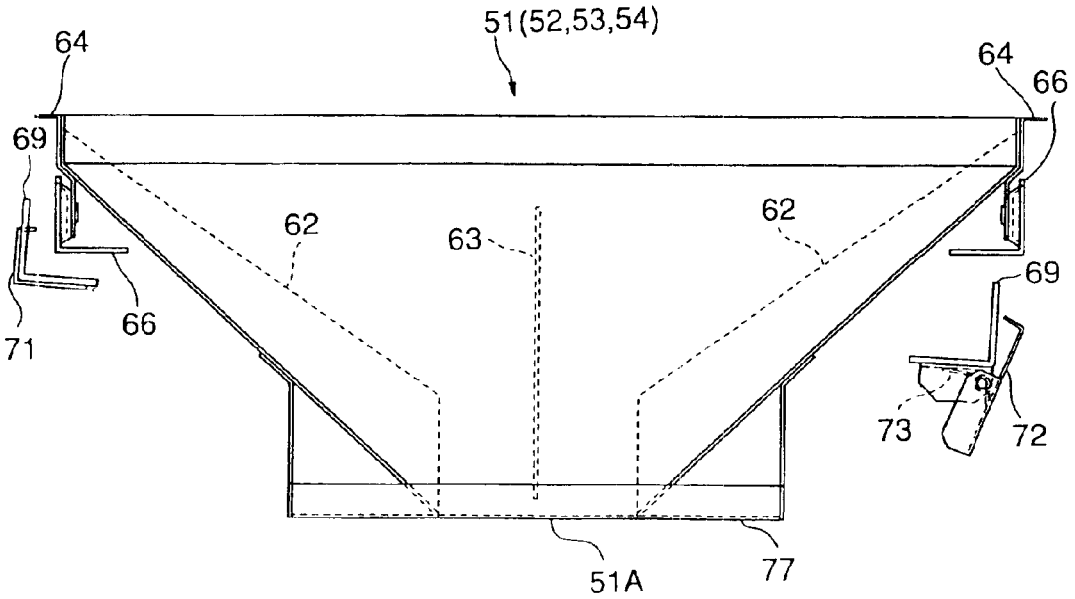
FIG. 12 is a front view of the hopper and the retaining member for explaining the procedure for mounting the hopper of the medication filling apparatus in accordance with the present invention.
Figure 13:
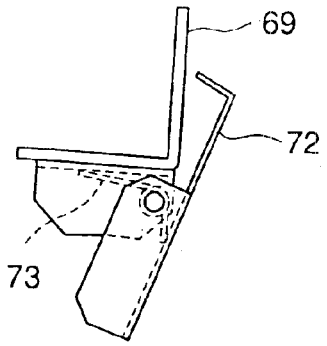
FIG. 13 is an enlarged view of the movable hook for explaining the operation of the movable hook of the medication filling apparatus in accordance with the present invention.

Furthermore, above the rails 59 of the lower door 5, retaining members (angles) 69 having substantially L-shaped sections are secured to the lower door 5, and the hoppers 51 through 54 are attached to the retaining members 69. In this case, a hook 71 projecting inward is secured to one side of the retaining member 69, and a movable hook 72 projecting inward in the same manner is rotatably attached to the retaining member 69 at the position opposing against the hook 71. The movable hook 72 is constantly rotationally urged by a spring 73 in a direction in which it juts out inside the retaining member 69 (FIG. 11 through FIG. 13). Micro switches 76 acting as the hopper detecting means are installed to the retaining members 69 at the positions corresponding to the locations where the hoppers 51 through 54 are installed.

Figure 9:
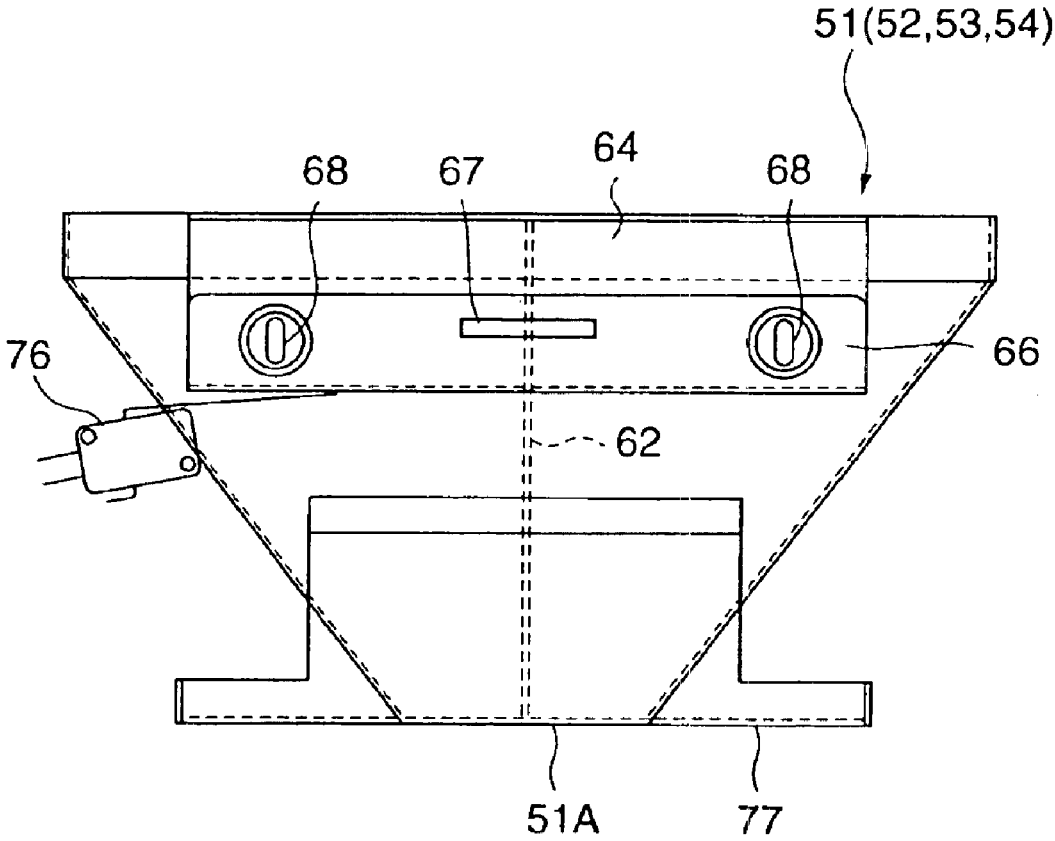
FIG. 9 is a side view of a hopper of the medication filling apparatus in accordance with the present invention.
Figure 10:
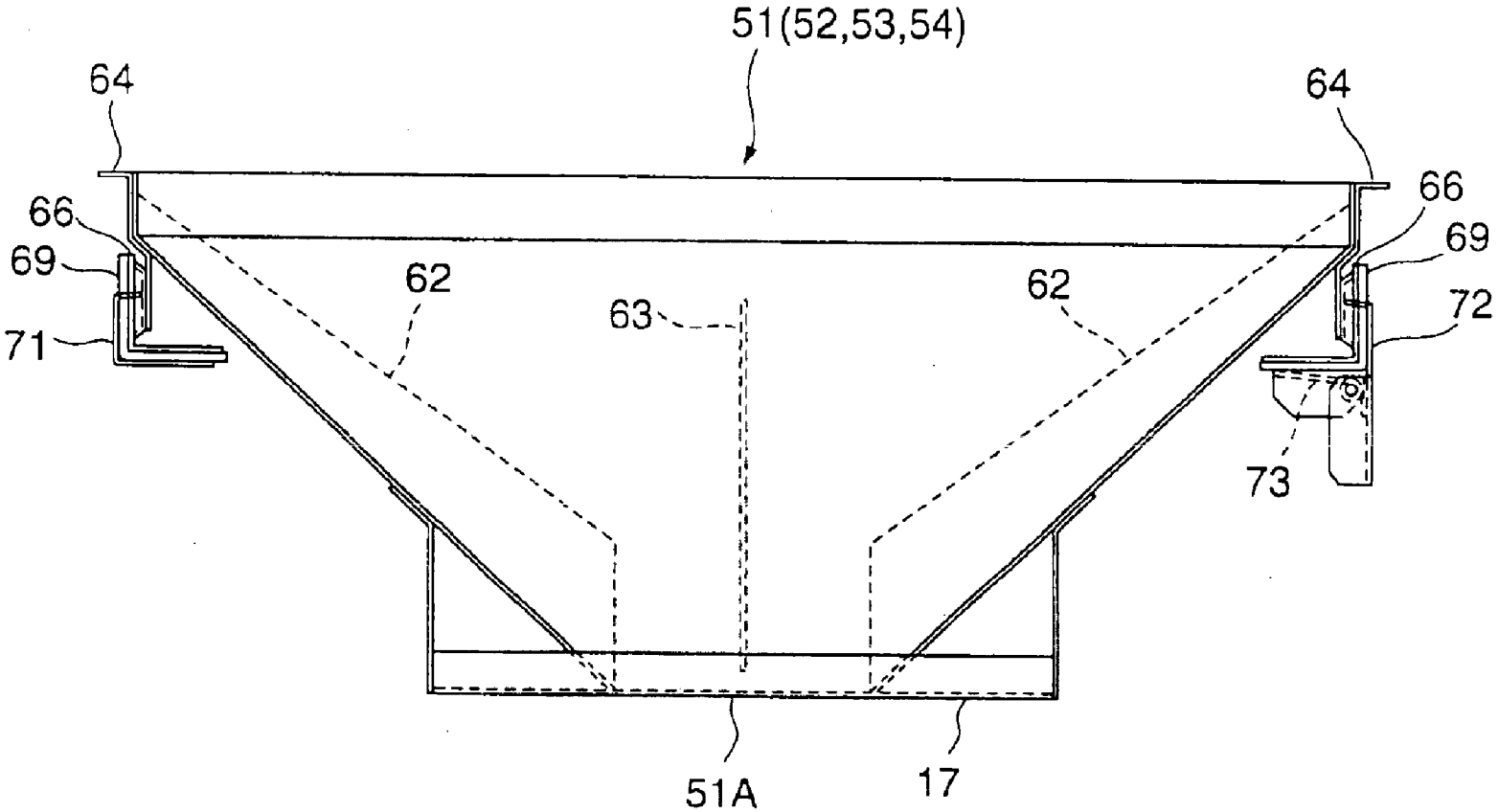
FIG. 10 is a front view of a hopper and a retaining member of the medication filling apparatus in accordance with the present invention.

To install the hoppers 51 through 54 to the retaining members 69, one of the retaining plates 66 is first rested on the retaining member 69, and at this time, the hook 71 is inserted and engaged in the engaging hole 67 of the retaining plate 66. Furthermore, the lower portion of the movable hook 72 is pushed inward against the urging force of the spring 73, and the movable hook 72 is circularly moved clockwise in FIG. 12 outside the retaining member 69 (FIG. 12 and FIG. 13). In this state, the other retaining plate 66 is rested on the retaining member 69, and the movable hook 72 is released. This causes the movable hook 72 to be circularly moved counterclockwise in FIG. 12 by the spring 73 to be inserted and engaged in the engaging hole 67 of the other retaining plate 66. This secures the hoppers 51 through 54 onto the retaining member 69, and the retaining plate 66 presses the micro switch 76, as illustrated in FIG. 9.

To remove the hoppers 51 through 54, the above procedure is reversed. First, the movable hook 72 is circularly moved to pull it out of the engaging hole 67, and the hoppers 51 through 54 is pulled upward aslant. This will release the engaging hole 67 of the other retaining plate 66 from the hook 71. Furthermore, removing the hoppers 51 through 54 sets the micro switch 76 in a non-pressed state. Thus, the hoppers 51 through 54 can be detachably installed on the retaining members 69, so that maintenance work, such as installation and cleaning, can be performed with great ease.

Figure 14:
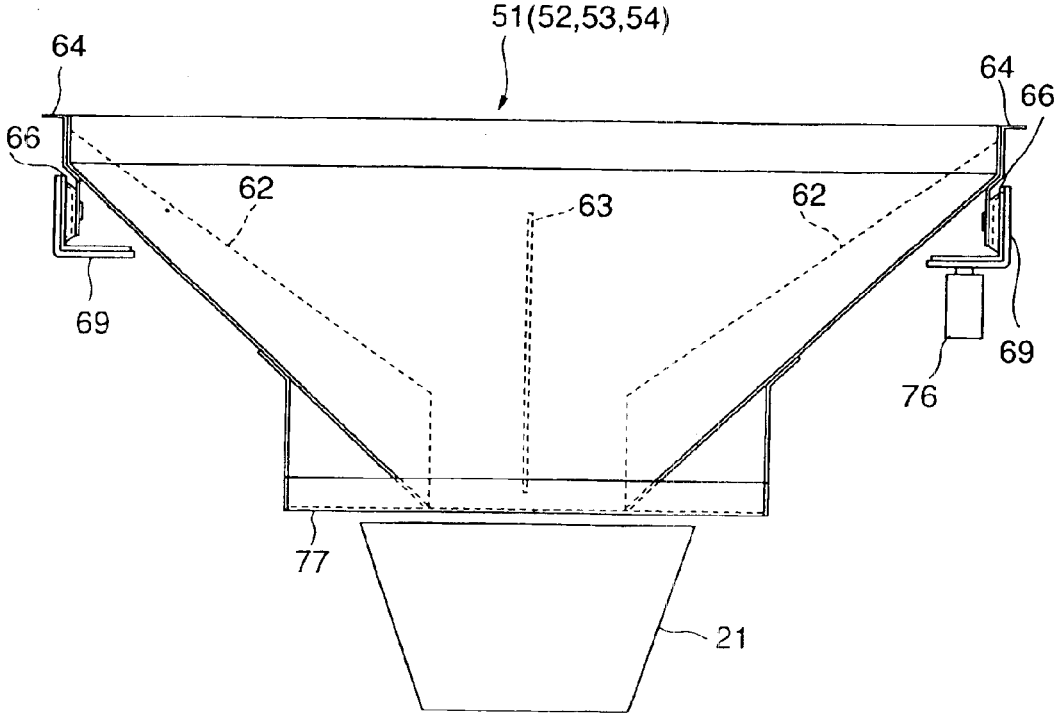
FIG. 14 is a front view of a hopper and a holding cell of the medication filling apparatus in accordance with the present invention.

Moreover, since the height of the bottom end of the retaining plate 66 can be adjusted as described above., the heights of the dispensing ports 51A through 54A of the hoppers 51 through 54 installed on the retaining members 69 can be adjusted within the range of the vertical dimensions of the slots 68 by adjusting the height at which the retaining plate 66 is screwed. Hence, the clearance between a holding cell 21, which will be discussed hereinafter, of the holding unit 61 positioned thereunder and the dispensing ports 51A through 54A can be also adjusted easily (FIG. 14).

Furthermore, the bottom outer side of each of the hoppers 51 through 54 is provided with an anti-spilling wall 77 installed over the full periphery of each of the dispensing ports 51A through 54A so that it projects outward. Thus, even if the medications that have been discharged through the dispensing ports 51A through 54A of the hoppers 51 through 54 and placed in the holding cells 21 bounce back and attempt to jump outside through the clearance between the dispensing ports 51A through 54A and the holding cells 21 (FIG. 14), it is possible to bounce back the medications toward the holding cells 21 by the anti-spilling walls 77.

Figure 16:
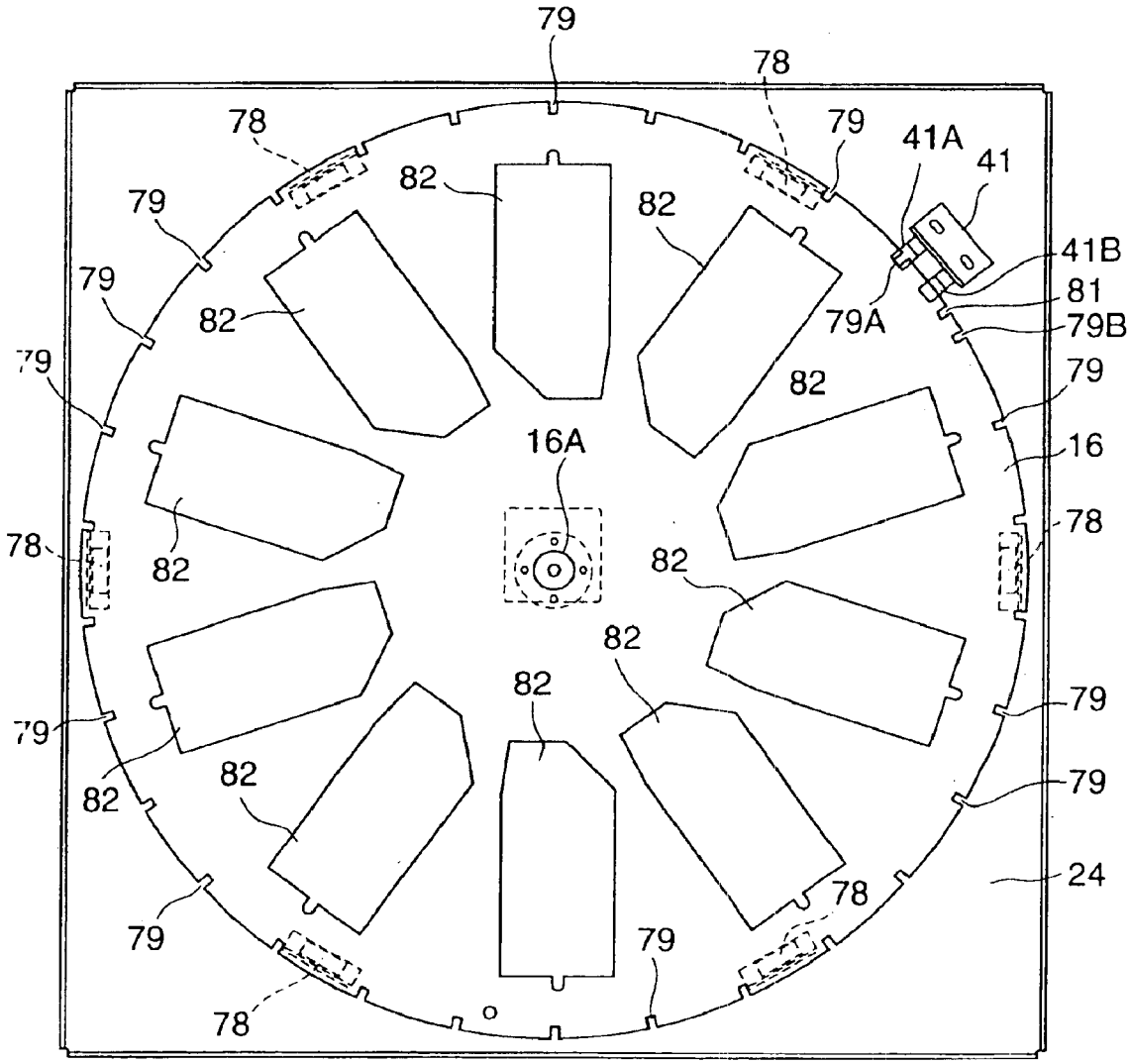
FIG. 16 is a top plan view of the rotating plate and a base plate of the medication filling apparatus in accordance with the present invention.
Figure 17:
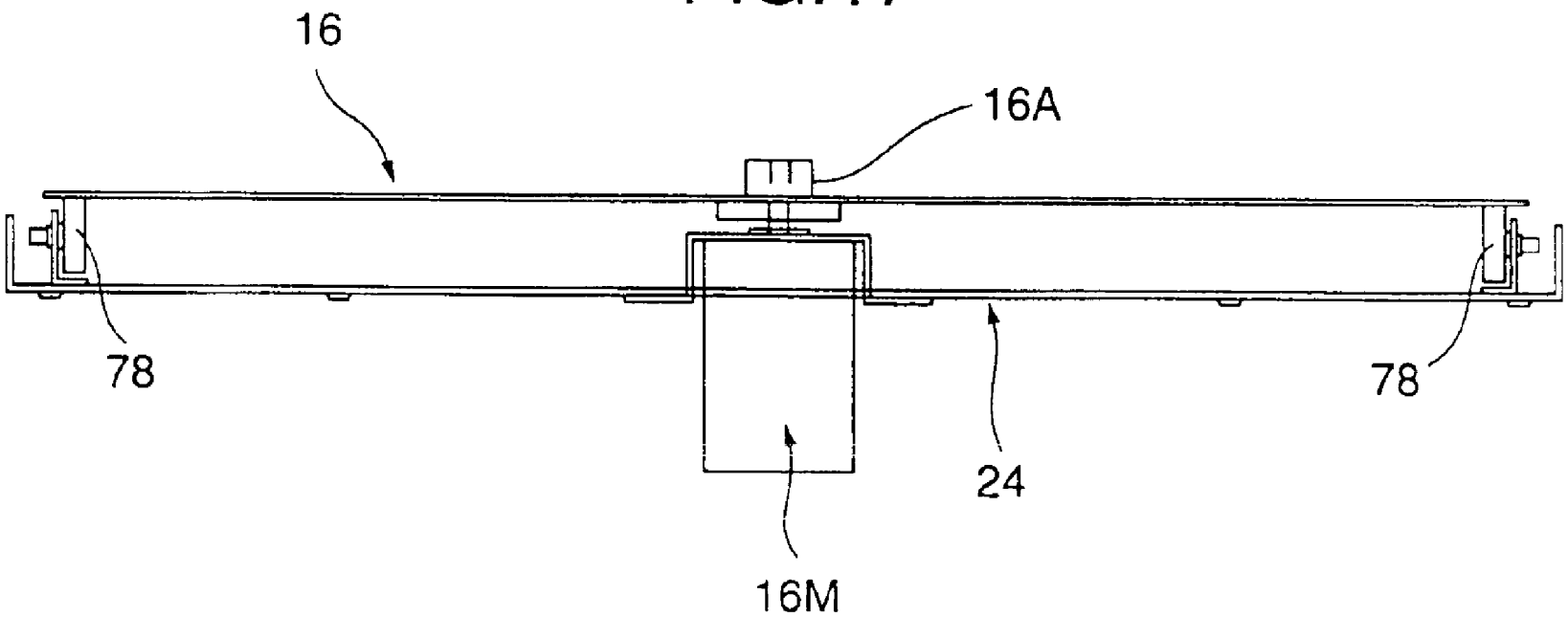
FIG. 17 is a longitudinal front view of the rotating plate and the base plate of the medication filling apparatus in accordance with the present invention.

The rotating plate 16 is rotationally installed on the base plate 24 attached to the lower door 5, as shown in FIG. 16 and FIG. 17, and the peripheral portion thereof is supported by a total of six rollers 78 . . . , thereby ensuring extremely stable rotation of the rotating plate 16. A rotating plate motor 16M (driving means) composed of a pulse motor disposed under the base plate 24 is coupled to a rotational center 16A of the rotating plate 16, and the rotating plate 16 is rotationally driven by the rotating plate motor 16M. The peripheral portion of the rotating plate 16 is provided with notches 79 at intervals of 12 degrees from the center thereof, and furthermore, notches 81 are additionally formed at positions of 8-degree intervals from a certain notch 79 (denoted by 79A in FIG. 16).

A transmissive rotational position detecting sensor 41 that performs a detecting operation according as whether a light beam irradiated upward is transmitted therethrough is provided under the peripheral portion of the rotating plate 16. The interval between detecting terminals 41A and 41B of the rotational position detecting sensor 41 is four degrees in terms of the rotational angle of the rotating plate 16. Hence, when the notch 81 and the notch 79 closest thereto (denoted by 79B in FIG. 16) reach a point right above them, an optical path for detection conducts in both detecting terminals 41A and 41B.

Figure 18:
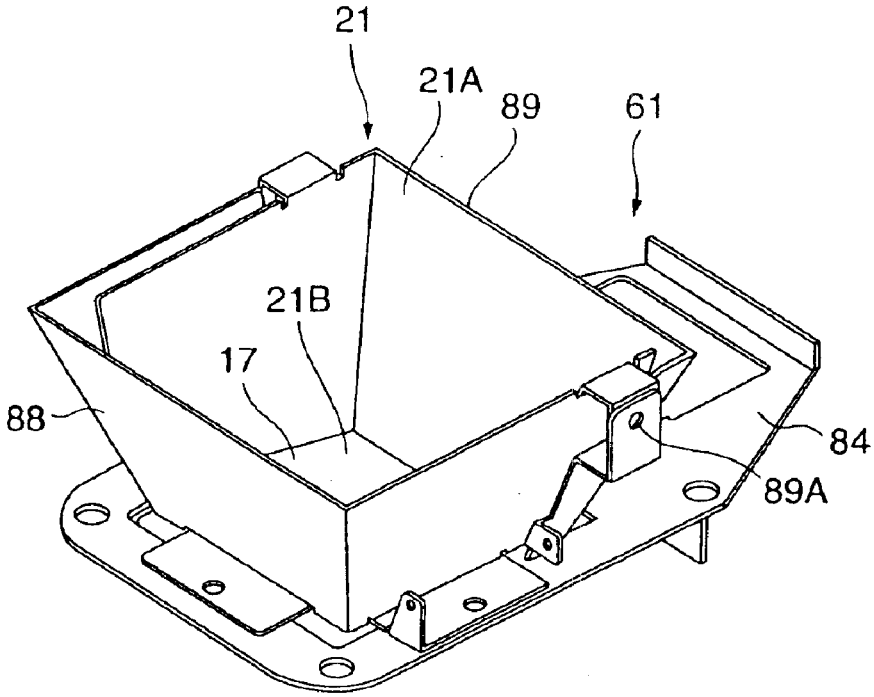
FIG. 18 is a perspective view of a holding unit of the medication filling apparatus in accordance with the present invention.
Figure 19:
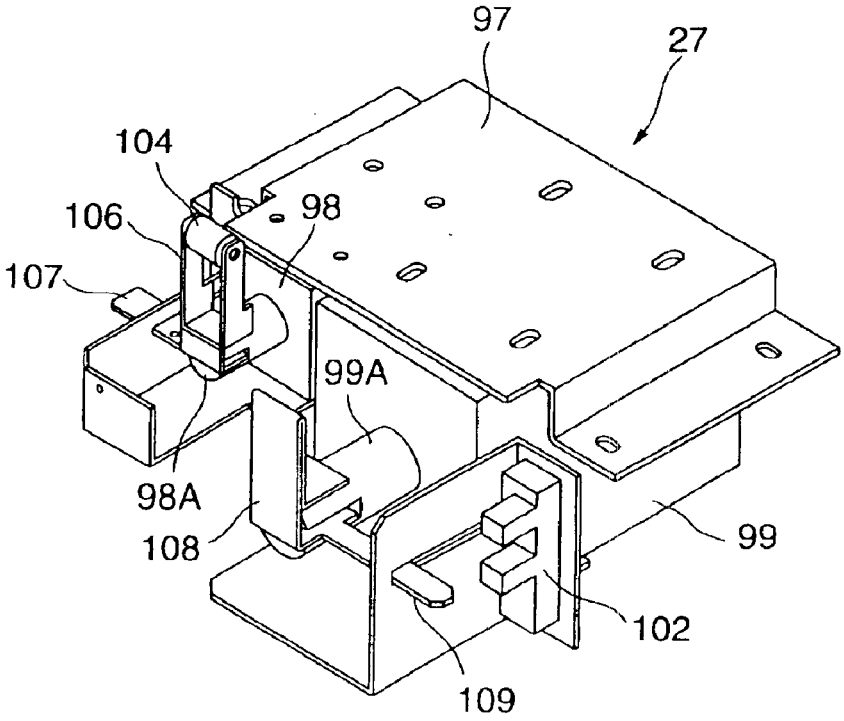
FIG. 19 is a perspective view of the solenoid unit of the medication filling apparatus in accordance with the present invention.

A total of ten (formed at intervals of 36 degrees in terms of the angles from the rotational center 16A of the rotating plate 16) openings 82 . . . are formed in the peripheral portion of the rotating plate 16 in this embodiment, and the holding units 61 . . . shown in FIG. 18 are mounted on the rotating plate 16 by snap type fixtures 100 such that they close the respective openings 82 . . . Under the rotating plate 16, a solenoid unit 27 (shown in FIG. 19) making up the driving means is installed at the front center of the base plate 24.

Figure 15:
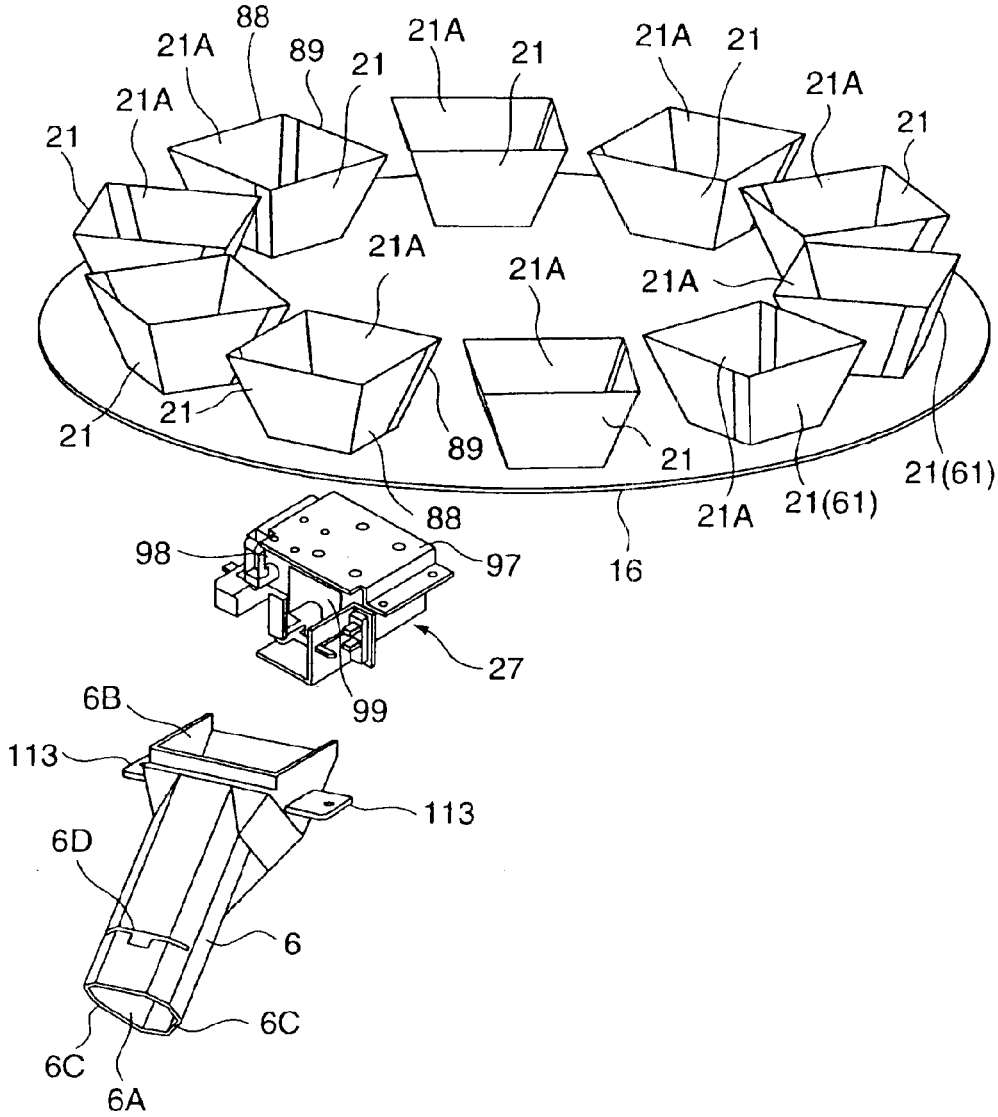
FIG. 15 is a perspective view showing the dispositions of holding units, a rotating plate, a solenoid unit, and a chute of the medication filling apparatus in accordance with the present invention.
Figure 32:
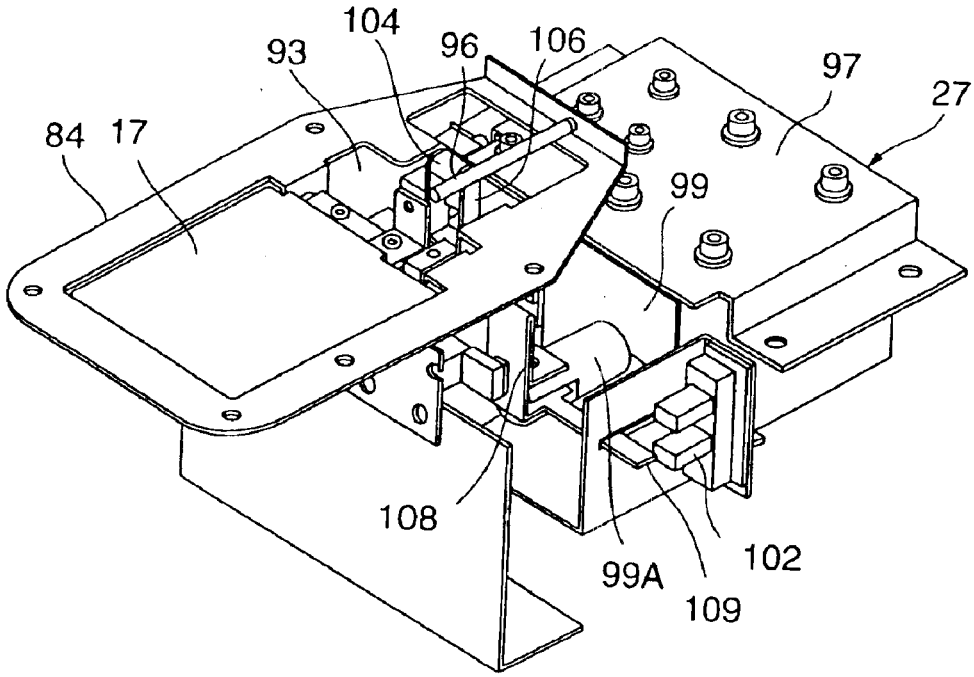
FIG. 32 is a perspective view of the holding unit excluding the holding cell, and the solenoid unit of the medication filling apparatus in accordance with the present invention wherein the shutter has been closed.
Figure 33:
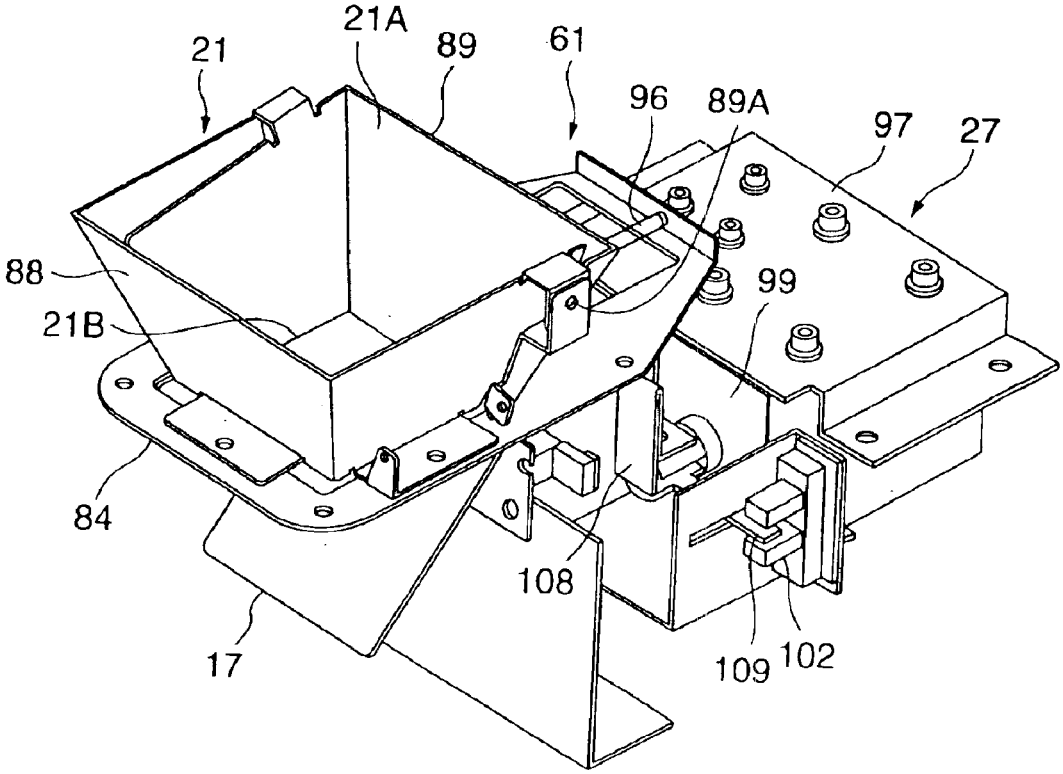
FIG. 33 is a perspective view of the holding unit and the solenoid unit of the medication filling apparatus in accordance with the present invention wherein the shutter has been opened.

The holding unit 61 is formed primarily of the holding cell 21 installed on a frame-like substrate 84 as shown in FIG. 32, and a shutter 17 disposed at the bottom of the holding cell 21. Each of the holding cells 21 . . . is equipped with an inlet 21A at the upper end and an outlet 21B at the lower end, and is shaped like a container that expands toward the inlet 21A, as a whole. The holding cells 21 are disposed on one circumference around the rotational center 16A of the rotating plate 16 by installing the holding units 61 . . . to the rotating plate 16 (FIG. 15).

The dispensing ports 51A through 54A of the hoppers 51 through 54 are disposed on one circumference, and the circumference coincides with the top of the circumference where the holding cells 21 . . . are provided, the inlets 21A of the holding cells 21 . . . are positioned right under the dispensing ports 51A through 54A (the clearance therebetween can be adjusted, as mentioned above). More specifically, as the rotating plate 16 rotates, the inlets 21A of the holding cells 21 are rotationally moved on the circumference on which the dispensing ports 51A through 54A of the hoppers 51 through 54 exist.

Figure 20:
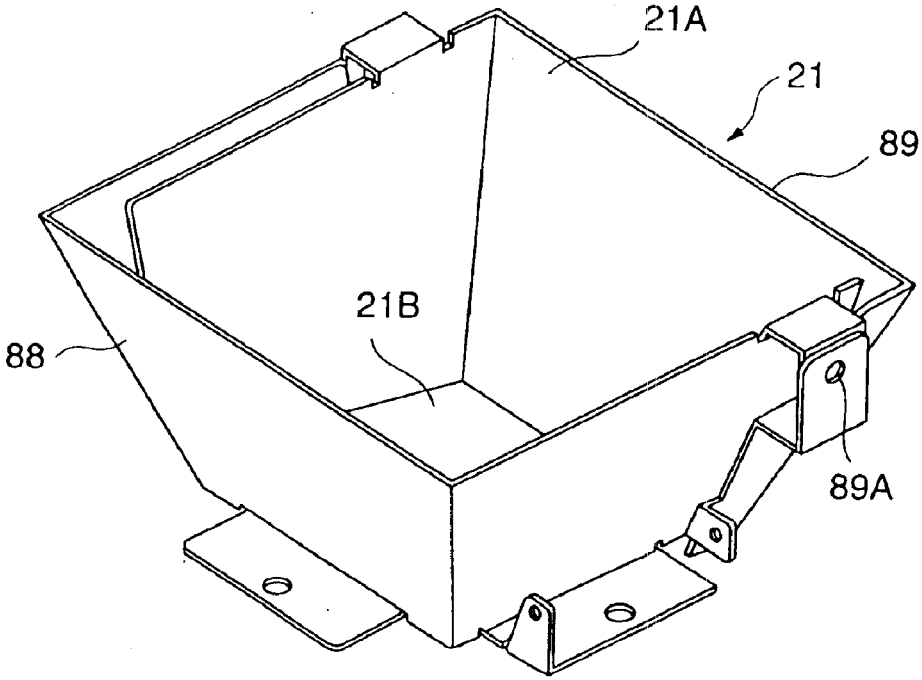
FIG. 20 is a perspective view of a holding cell of the medication filling apparatus in accordance with the present invention.
Figure 21:
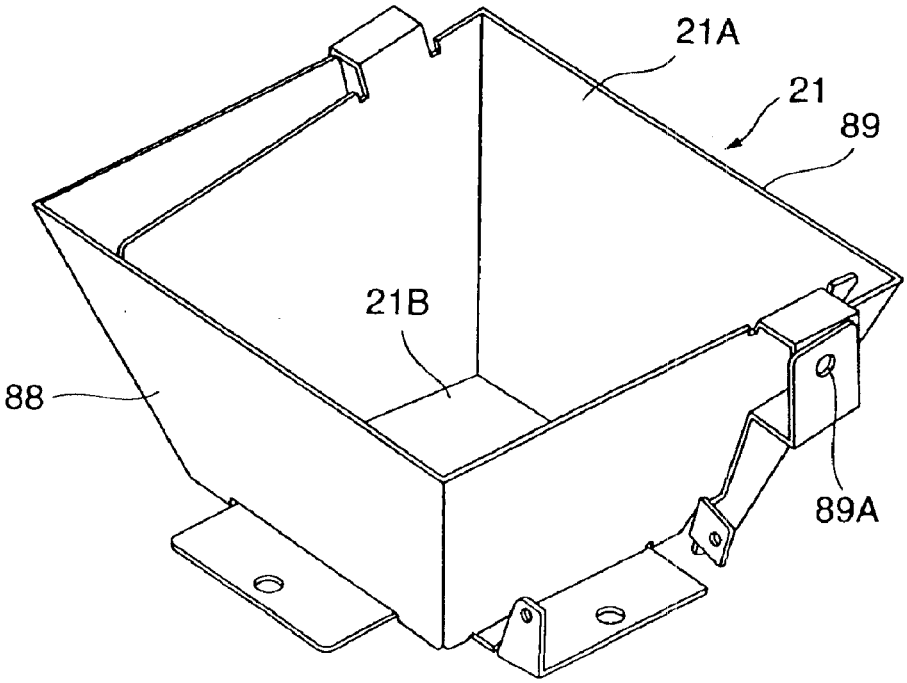
FIG. 21 is a perspective view of the holding cell of the medication filling apparatus in accordance with the present invention wherein the movable cell has moved.
Figure 22:
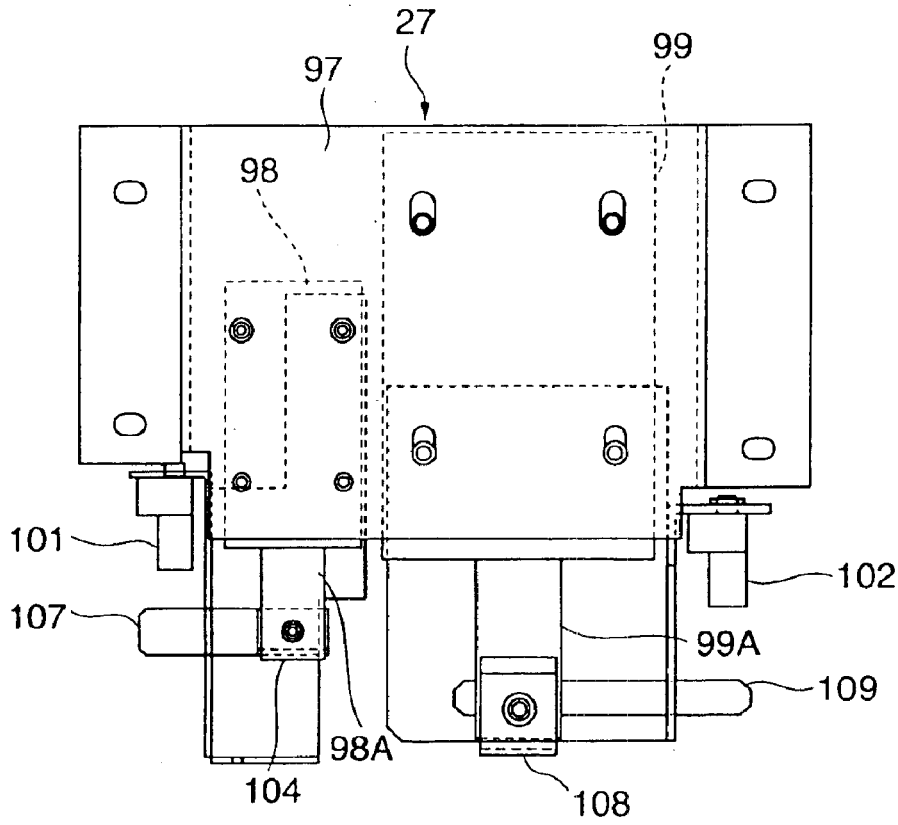
FIG. 22 is a top plan view of the solenoid unit of the medication filling apparatus in accordance with the present invention.
Figure 23:
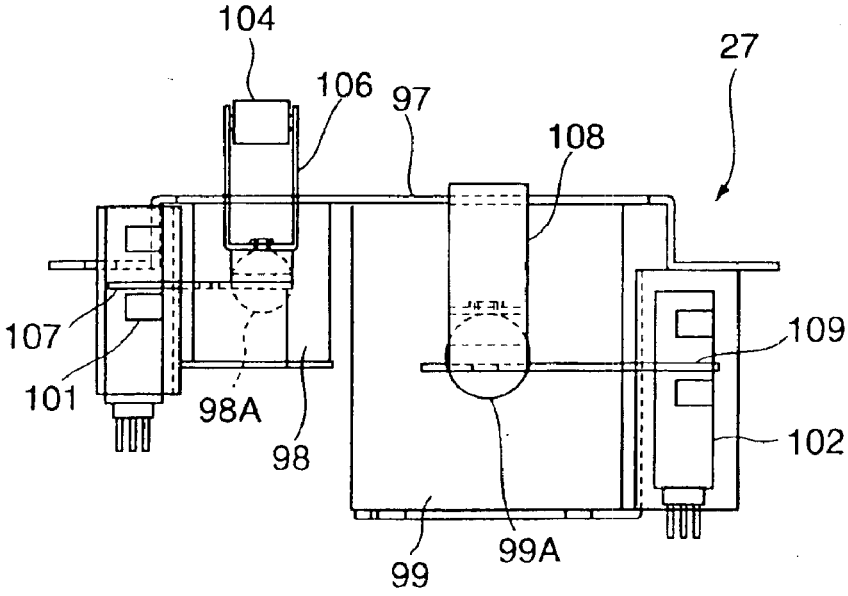
FIG. 23 is a front view of the solenoid unit of the medication filling apparatus in accordance with the present invention.
Figure 24:
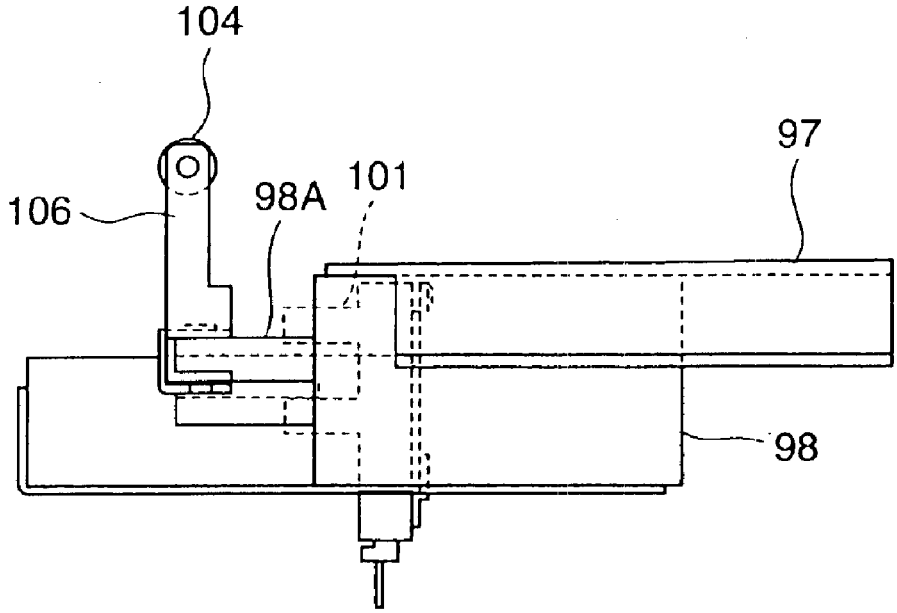
FIG. 24 is a longitudinal side view of a cell solenoid portion of the solenoid unit of the medication filling apparatus in accordance with the present invention.
Figure 25:
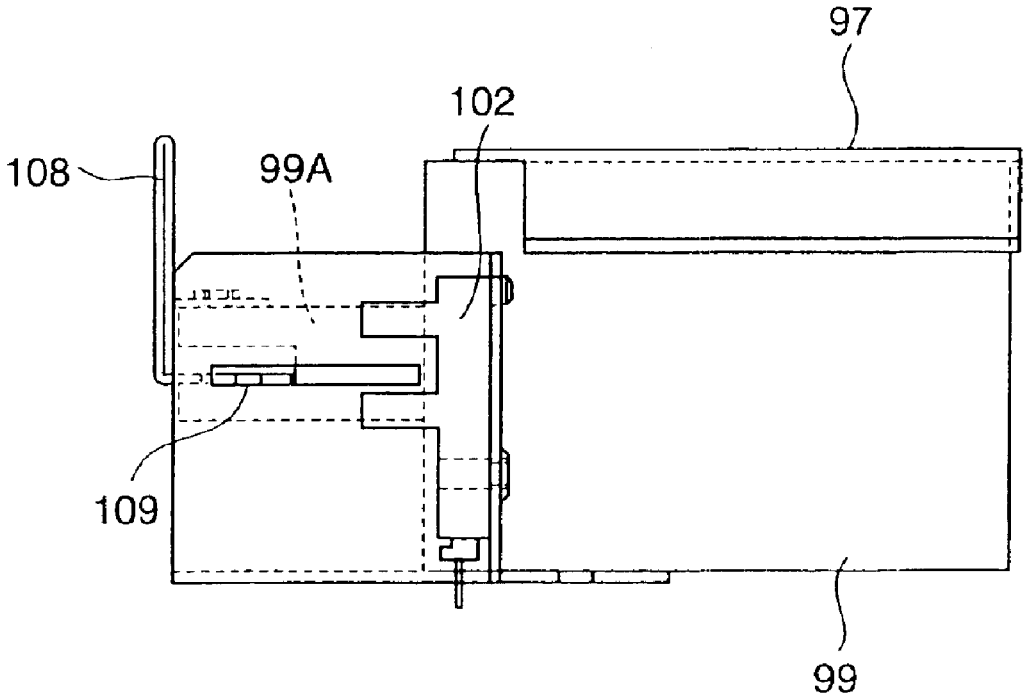
FIG. 25 is a longitudinal side view of a shutter solenoid portion of the solenoid unit of the medication filling apparatus in accordance with the present invention.

In this case, each of the holding cells 21 is formed of a substantially U-shaped fixed cell 88 fixed to the substrate 84 and a substantially L-shaped or U-shaped movable cell 89 which is rotationally attached to the fixed cell 88 (FIG. 20). The movable cell 89 is combined with the fixed cell 88, and shaped like a container as a whole mentioned above. In the movable cell 89, the outer upper edge is pivotally supported (the pivotal support is denoted by 89A) by the fixed cell 88. Hence, when the movable cell 89 has been circularly moved (moved) outer side, then the outlet 21B at the bottom is expanded, as shown in FIG. 21.

Figure 31:
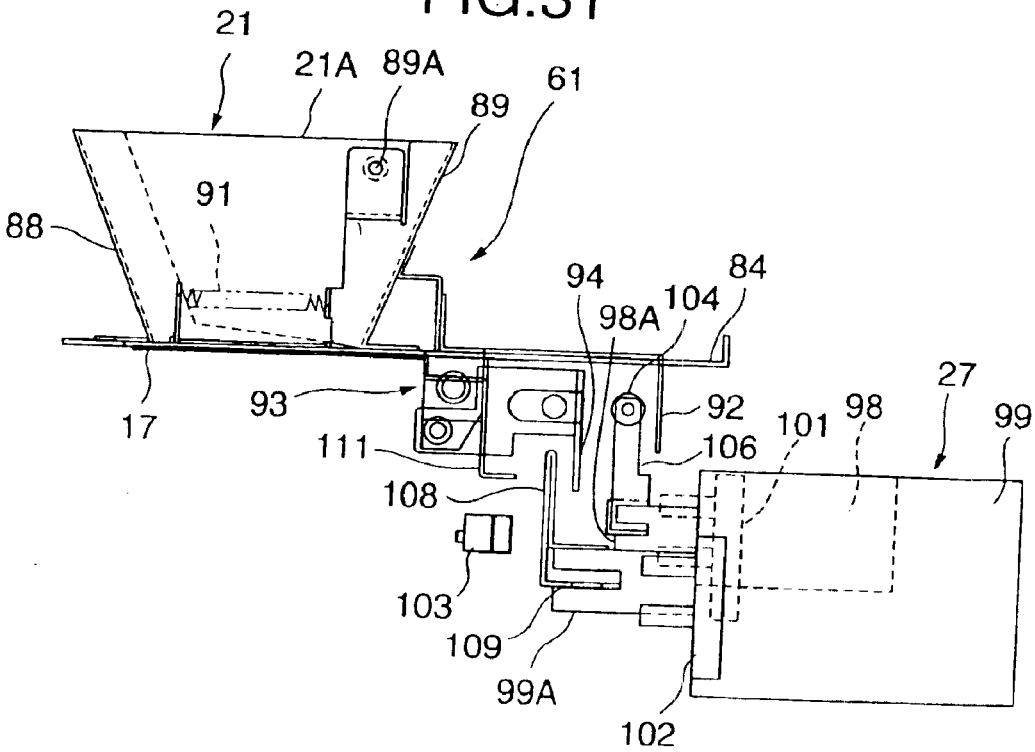
FIG. 31 is a side view of the holding unit and the solenoid unit of the medication filling apparatus in accordance with the present invention wherein the shutter has been closed.

The movable cell 89 is constantly urged by a spring 91 shown in FIG. 31 in the direction for narrowing the outlet 21B. Furthermore, the outer surface of the movable cell 89 is provided with an operating plate 92 that suspends downward and juts out from the bottom of the substrate 84 (the rotating plate 16), as shown in FIG. 31.

Figure 34:
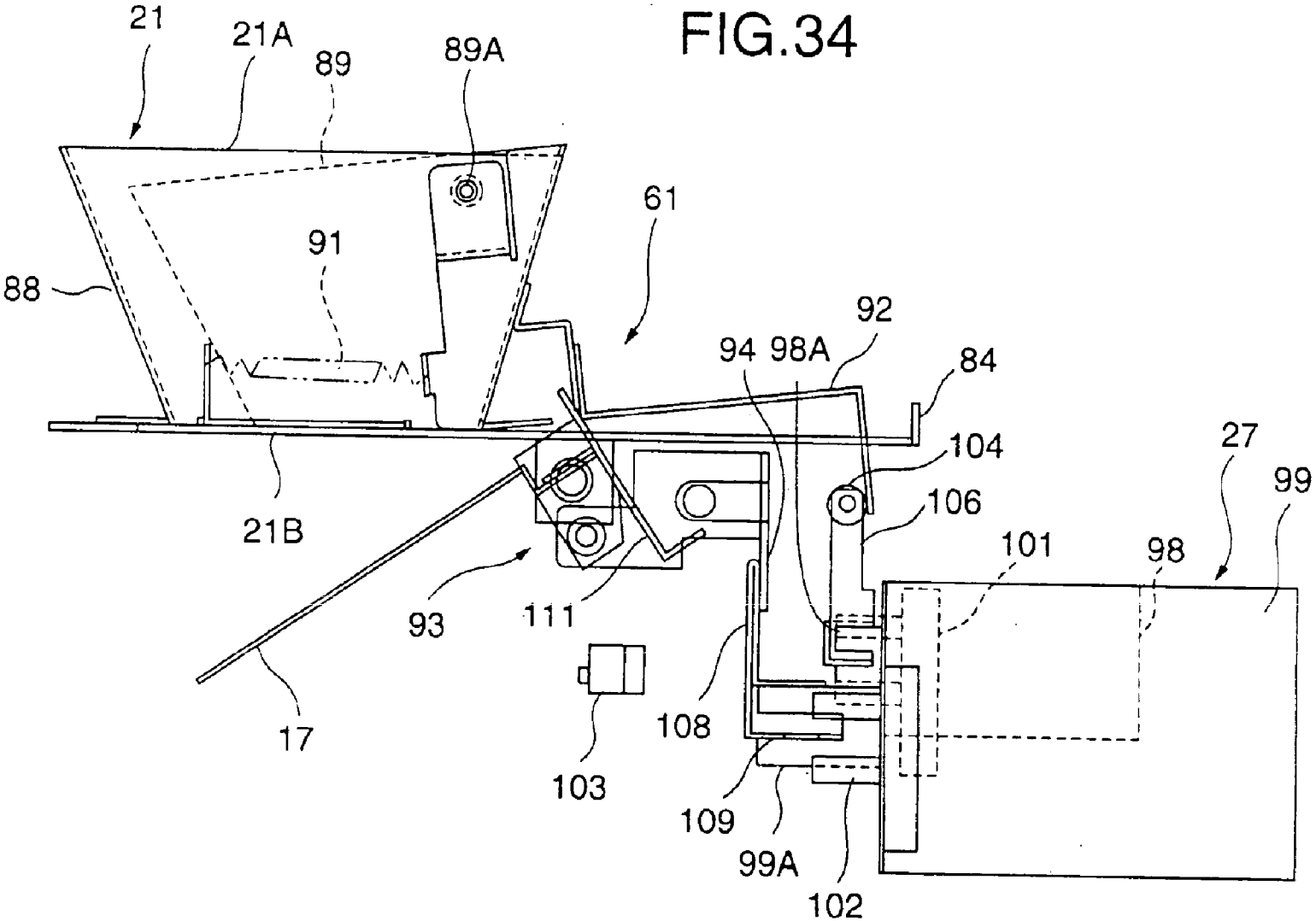
FIG. 34 is a side view of the holding unit and the solenoid unit of the medication filling apparatus in accordance with the present invention wherein the shutter has been opened.
Figure 35:
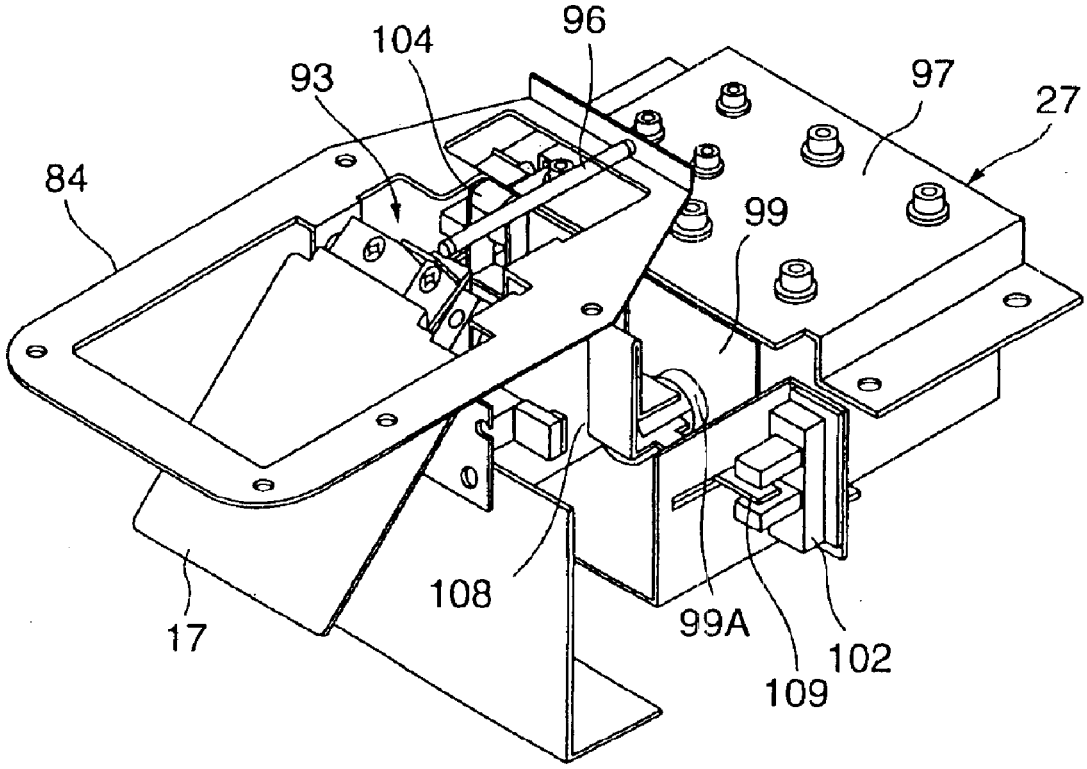
FIG. 35 is a perspective view of the holding unit excluding the holding cell, and the solenoid unit of the medication filling apparatus in accordance with the present invention wherein the shutter has been opened.

The shutter 17 is pivotally supported by a linking mechanism 93 at the bottom of the substrate 84, and positioned in the opening 82. The linking mechanism 93 converts the horizontal travel of the operating plate 94 toward the rear (toward the rotational center 16A of the rotating plate 16) into the rotational motion of the shutter 17. The shutter 17 is provided with a substantially L-shaped sensor plate 111 that suspends downward. The shutter 17 is always urged by a spring 96 shown in FIG. 32 to close the outlet 21B (in a horizontal state) of the holding cell 21. When the operating plate 94 is moved backward against the spring 96, the distal end of the shutter 17 comes down to open the outlet 21B (FIG. 34).

The solenoid unit 27 mentioned above is provided with a frame 97, a cell solenoid 98 acting as a driving means attached to the frame 97, a shutter solenoid 99, a cell opening sensor (a means for detecting the operation of the movable cell) 101 composed of a photocoupler, a shutter opening sensor (shutter opening/closing detecting means) 102, a reflected-light type shutter closing sensor (means for detecting the opening/closing of the shutter) 103, etc., as shown in FIG. 22 through FIG. 25.

The distal end of a plunger 98A of the cell solenoid 98 is provided with a driving plate 106 that extends upward and has a roller 104 on its distal end. Furthermore, a sensor plate 107 projecting sideways is attached to the plunger 98A. A driving plate 108 extending upward is attached to the distal end of a plunger 99A of the shutter solenoid 99, and a sensor plate 109 projecting sideways is attached to the plunger 99A.

With the plungers 98A and 99A of the two solenoids 98 and 99 jutting out, the driving plate 106 is positioned and detachably installed at the front side of the operating plate 92 (on the circumferential side of the rotating plate 16) with an interval provided therebetween, and the driving plate 108 is also positioned and detachably installed at the front side of the operating plate 94 with an interval provided therebetween, as shown in FIG. 31. The solenoid unit 27 (the driving plates 106, 108, etc.) will not interfere at all with the travels of the operating plates 92 and 94, and the sensor plate 111 as the rotating plate 16 rotates.

When the cell solenoid 98 is energized, and the plunger 98A is sucked in, the roller 104 of the driving plate 106 abuts against the operating plate 92 of the holding unit 61 that has moved to the front center of the base plate 24 to pull in, so that the movable cell 89 is circularly moved, causing the outlet 21B of the holding cell 21 to open (FIG. 34). At the same time, the sensor plate 107 cuts off the optical path of the cell opening sensor 101.

Furthermore, when the shutter solenoid 99 is energized, and the plunger 99A is sucked in, the driving plate 108 abuts against the operating plate 94 of the holding unit 61 to pull in, so that the shutter 17 is circularly moved, releasing the outlet 21B of the holding cell 21 (FIG. 34). At the same time, the sensor plate 109 cuts off the optical path of the shutter opening sensor 102. When the shutter 17 is in a closed state (horizontal), as shown in FIG. 31, the sensor plate 111 opposes against the top of the shutter closing sensor 103 to reflect light, so that the closing of the shutter 17 is detected.

Figure 26:
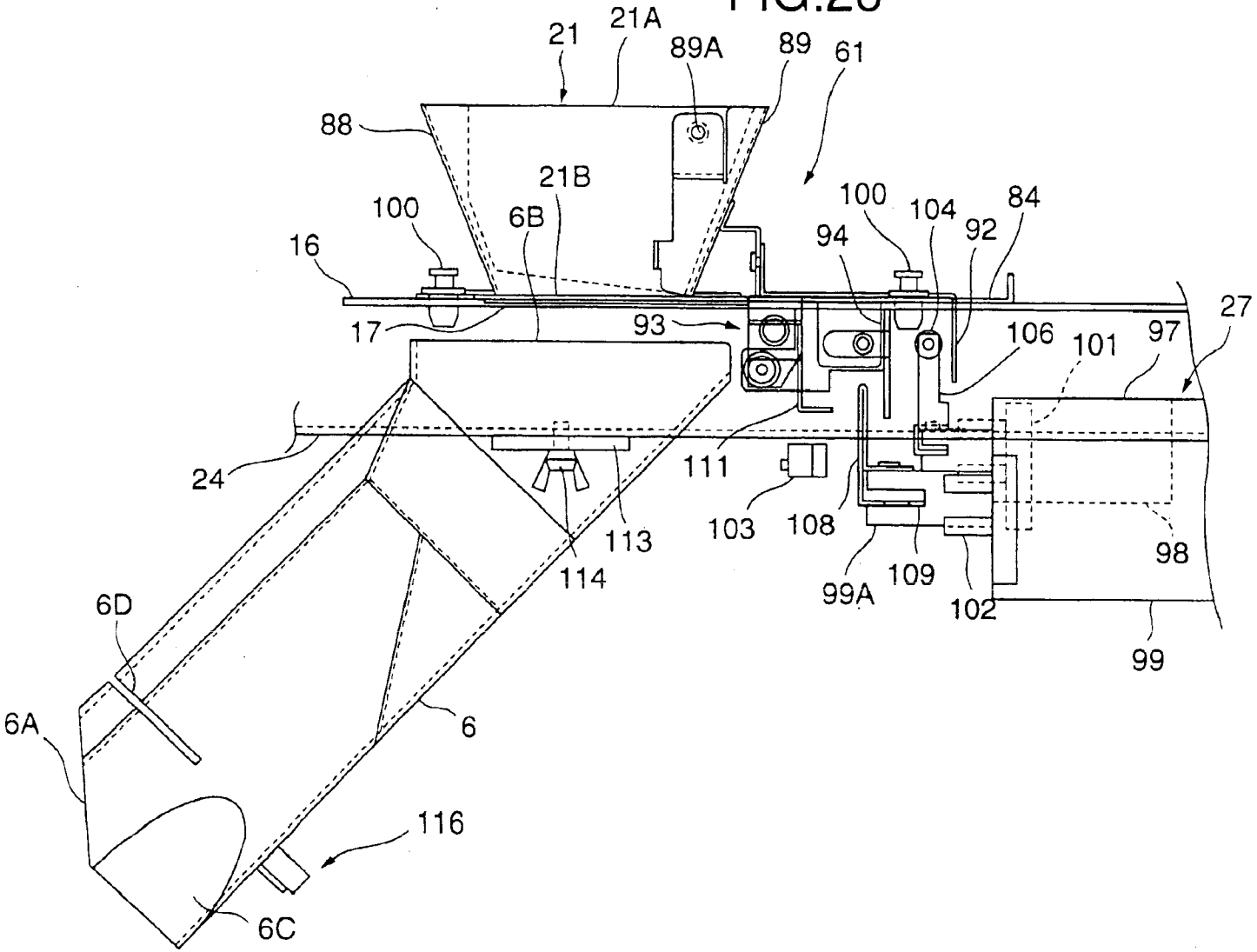
FIG. 26 is a side view of the holding unit, the solenoid unit, the chute, etc. of the medication filling apparatus in accordance with the present invention.
Figure 27:
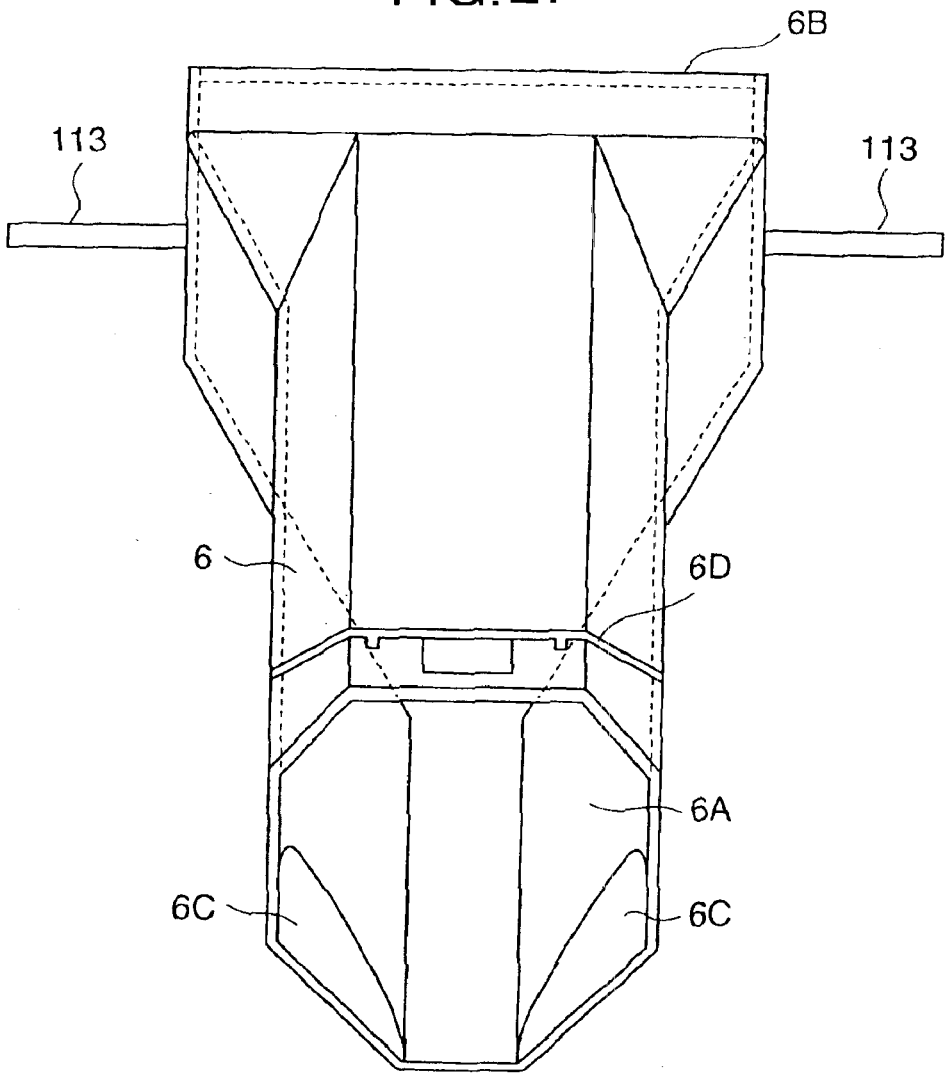
FIG. 27 is a top plan view of the chute of the medication filling apparatus in accordance with the present invention.
Figure 28:
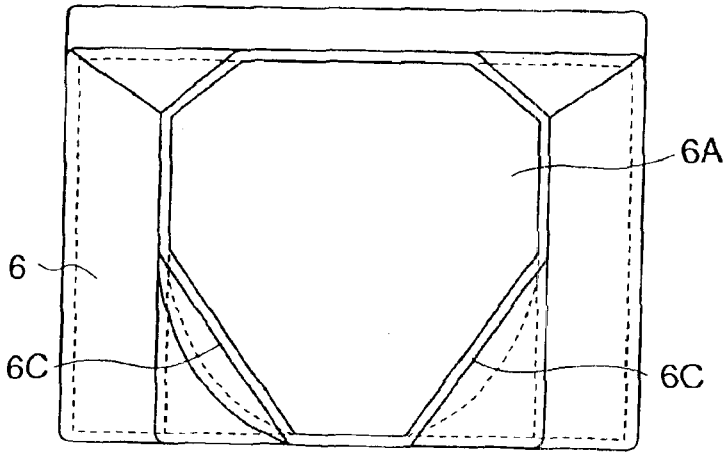
FIG. 28 is a bottom view of the chute of the medication filling apparatus in accordance with the present invention.
Figure 29:
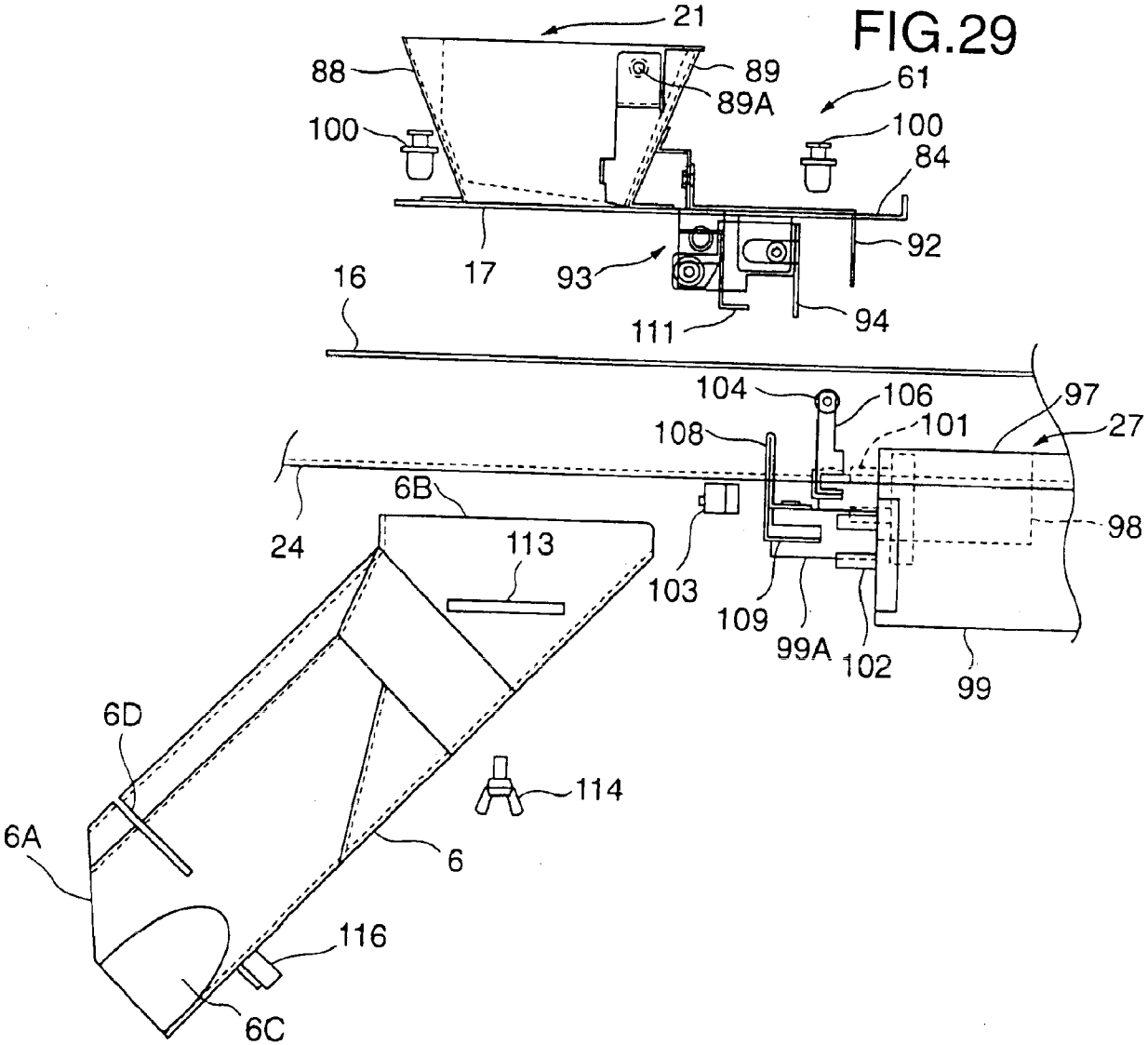
FIG. 29 is an exploded side view of the holding unit, the solenoid unit, chute, etc. of the medication filling apparatus in accordance with the present invention.

The chute 6 is formed of a transparent, hard synthetic resin, and has a pipe-like shape with a polygonal section, as shown in FIG. 27 and FIG. 28. Mounting flanges 113 and 113 that laterally project from the top of the chute 6 are detachably installed from under to the front center of the base plate 24 by thumbscrews 114 (FIG. 26). With this arrangement, an upper end inlet 6B of the chute 6 opens upward at the front center of the base plate 24, and the solenoid unit 27 is positioned behind it. Since the chute 6 is mounted on the base plate 24 by the thumbscrews 114 as mentioned above, only the chute 6 can be easily removed without using a tool for the purpose of maintenance, such as cleaning, of the interior of the chute 6, thus permitting improved workability.

The chute 6 extends aslant downward to the front to face the filling unit 5A on the front surface of the lower door 5, as described above, and its lower end outlet 6A opens in the filling unit 5A. A detachable cover 26 is installed near the outlet 6A of the chute 6. The outlet 6A can be opened and closed by this cover 26. In the drawings, reference numeral 6D denotes a slit in which the cover 26 is inserted. Furthermore, a chute sensor 116 composed of a magnet switch is attached to the bottom surface of the chute 6, that is the upper side of the cover 26. The chute sensor 116 detects the opening and closing of the cover 26 by the magnet (not shown) provided at the lower end of the cover 26.

The chute 6 is formed to be thick in order to expand its capacity, but has slope surfaces 6C at its distal bottom surface so that it is tapered from both sides. This arrangement allows medications to be charged in a container V without spilling even if the mouth of the container V, which will be discussed hereinafter, is small. As previously mentioned, the outlet 21B of the holding cell 21 of the holding unit 61 that has been moved to the front center of the base plate 24, and the shutter 17 match the upper side of the upper end inlet 6B of the chute 6.

Figure 4:
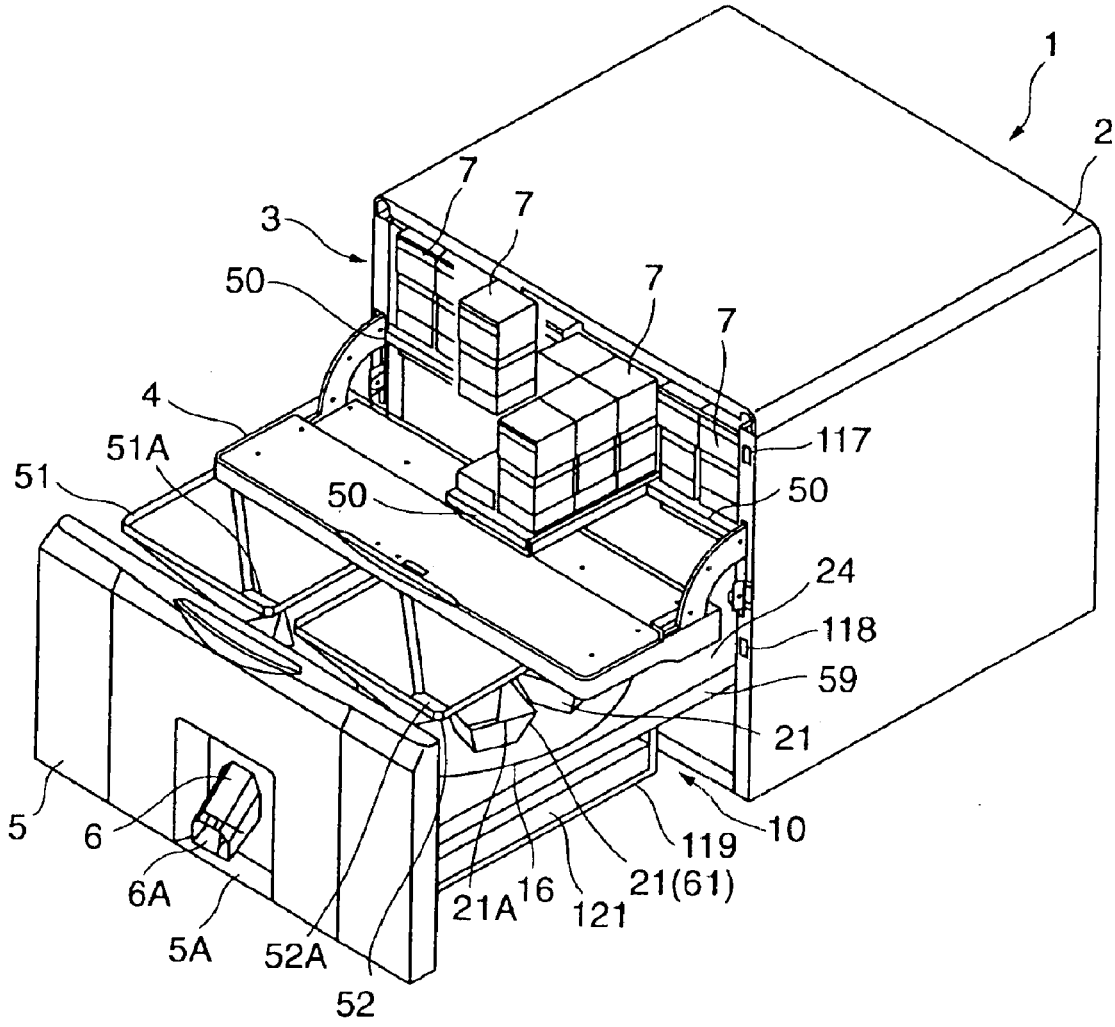
FIG. 4 is a perspective view of the medication filling apparatus in accordance with the present invention wherein the upper and lower doors of the apparatus are open.
Figure 5:
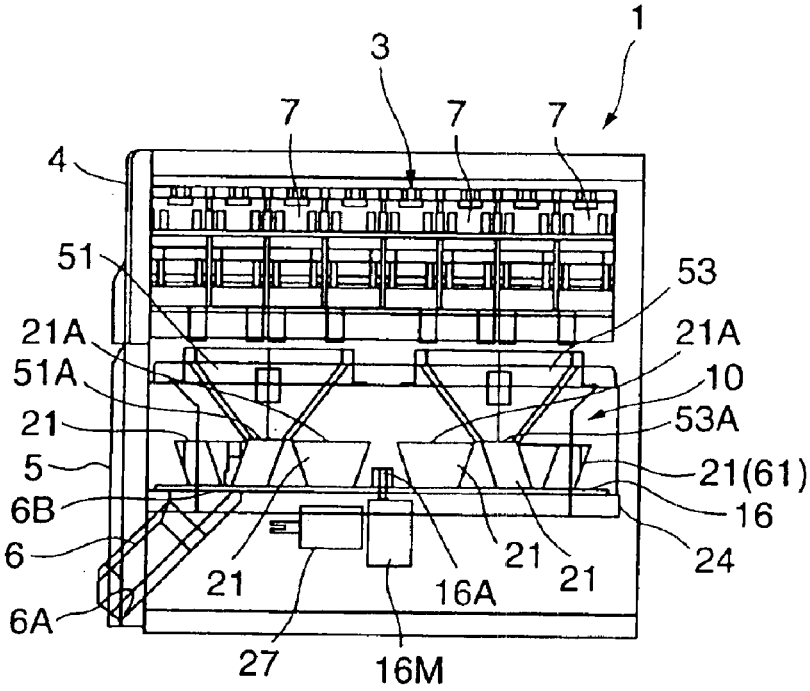
FIG. 5 is a longitudinal side view of the medication filling apparatus in accordance with the present invention.

In FIG. 4, reference numerals 117 and 118 denote an upper door sensor and a lower door sensor (both are formed of micro switches or the like) for detecting the opening and closing of the upper door 4 and the lower door 5, respectively. The bottom surface of the rail 59 or the base plate 24 is provided with a rack plate 119 laterally opened, and an electronic component substrate 121 is accommodated in the rack plate 119 such that it can be laterally slid and drawn out together with the lower door 5. Accordingly, the lower door 5 is drawn out and the electronic component substrate 121 is drawn out sideways for easier maintenance.

Figure 37:
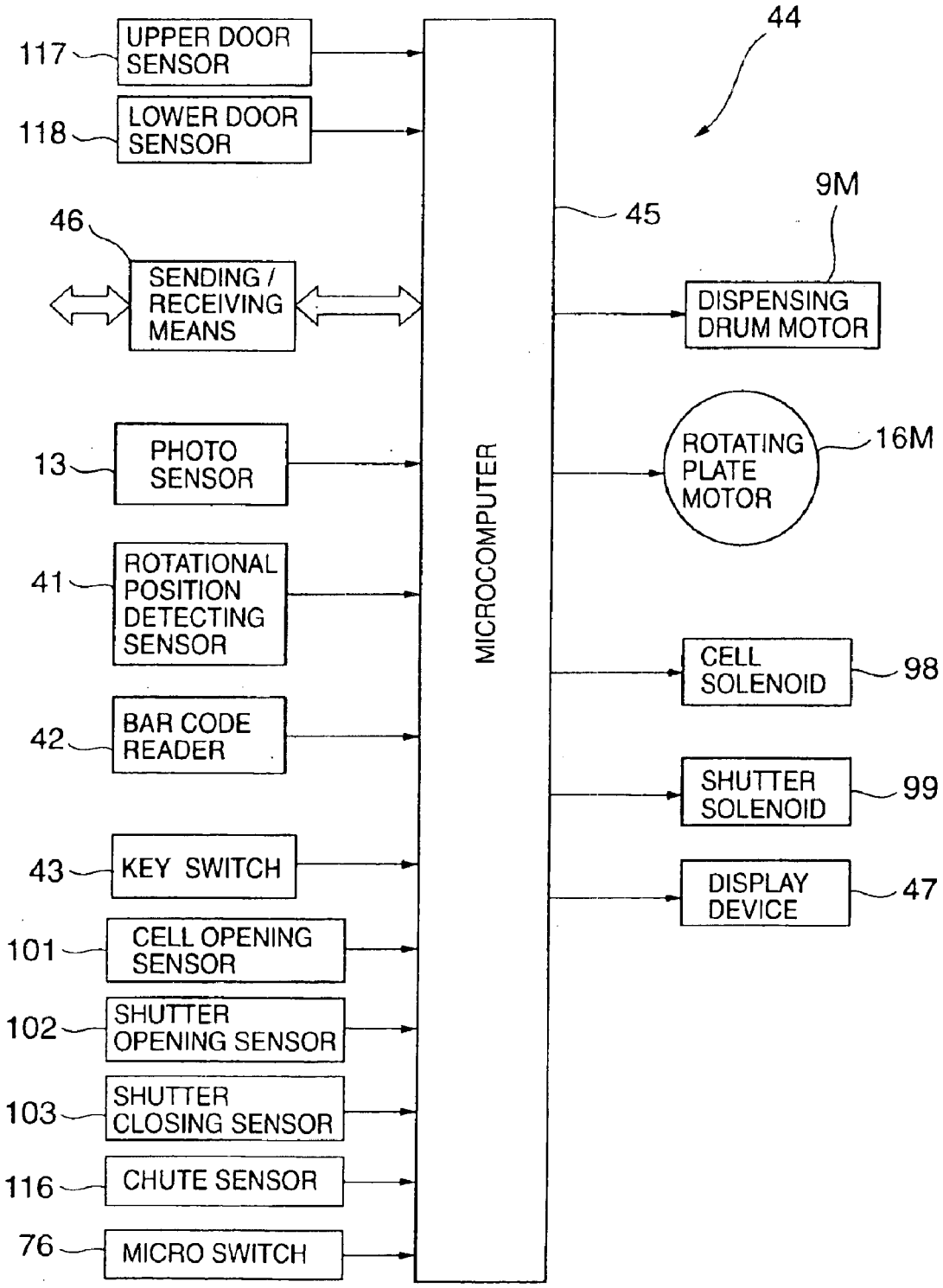
FIG. 37 is a block diagram of a controller of the medication filling apparatus in accordance with the present invention.

FIG. 37 shows a block diagram of a controller 44 of the medications filling apparatus 1 in accordance with the present invention. The controller 44 is constituted by a general-purpose microcomputer 45. A sending and receiving means 46 for sending and receiving data to and from an external personal computer or the like, which is not shown, is connected to the microcomputer 45. The photosensor 13 of the dispensing counter 8, the rotational position detecting sensor 41 for detecting the rotational position of the rotating plate 16, the cell opening sensor 101, the shutter opening sensor 102, the shutter closing sensor 103, the chute sensor 106, the micro switches 76 (actually four), the upper door sensor 117, the lower door sensor 118, the bar code reader 42, and the key switch 43 are connected to the input terminal of the microcomputer 45.

Furthermore, a dispensing drum motor 9M for rotating the dispensing drum 9 of the dispensing counter 8, the rotating plate motor 16M, the cell solenoid 98 and the shutter solenoid 99 of the solenoid unit 27, and a display device 47 are connected to the output terminal of the microcomputer 45.

Figure 38:
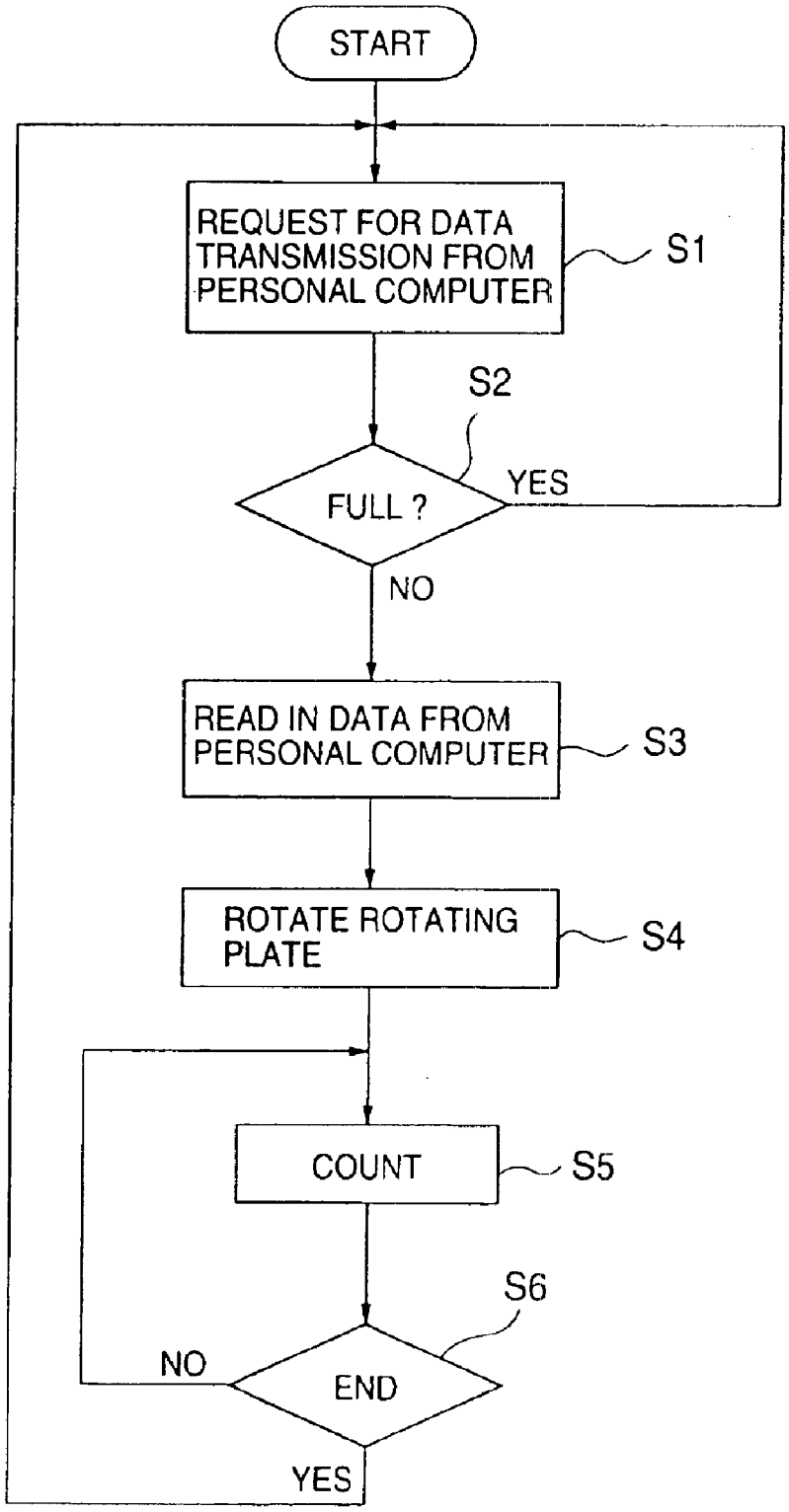
FIG. 38 is a flowchart illustrating a program of a microcomputer of the medication filling apparatus in accordance with the present invention.
Figure 39:
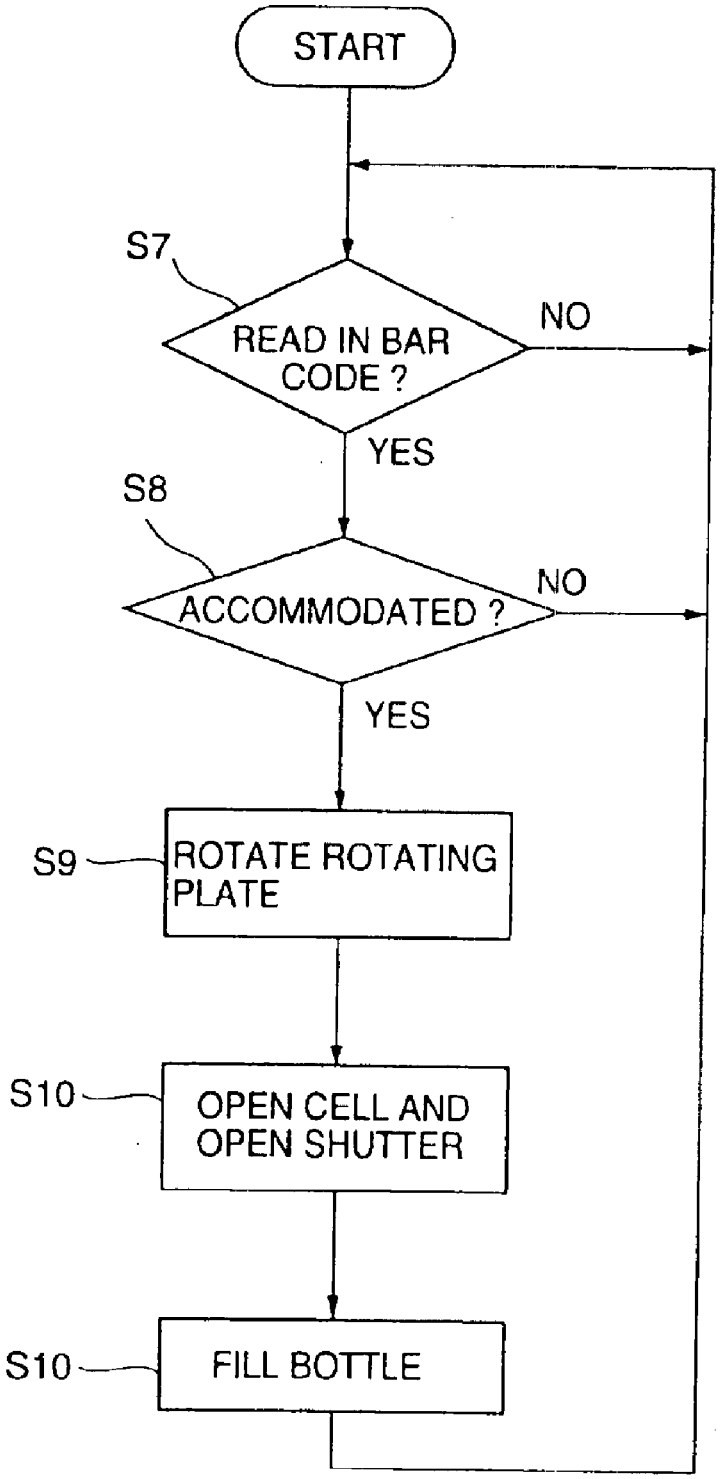
FIG. 39 is another flowchart illustrating the program of the microcomputer of the medication filling apparatus in accordance with the present invention.

The operation of the medication filling apparatus 1 having the construction described above will now be explained. FIG. 38 shows a flowchart of a program of the microcomputer 45 for the operation of dispensing medications, and FIG. 39 shows another flowchart of a program of the microcomputer 45 for the operation of charging medications.

Figure 30:
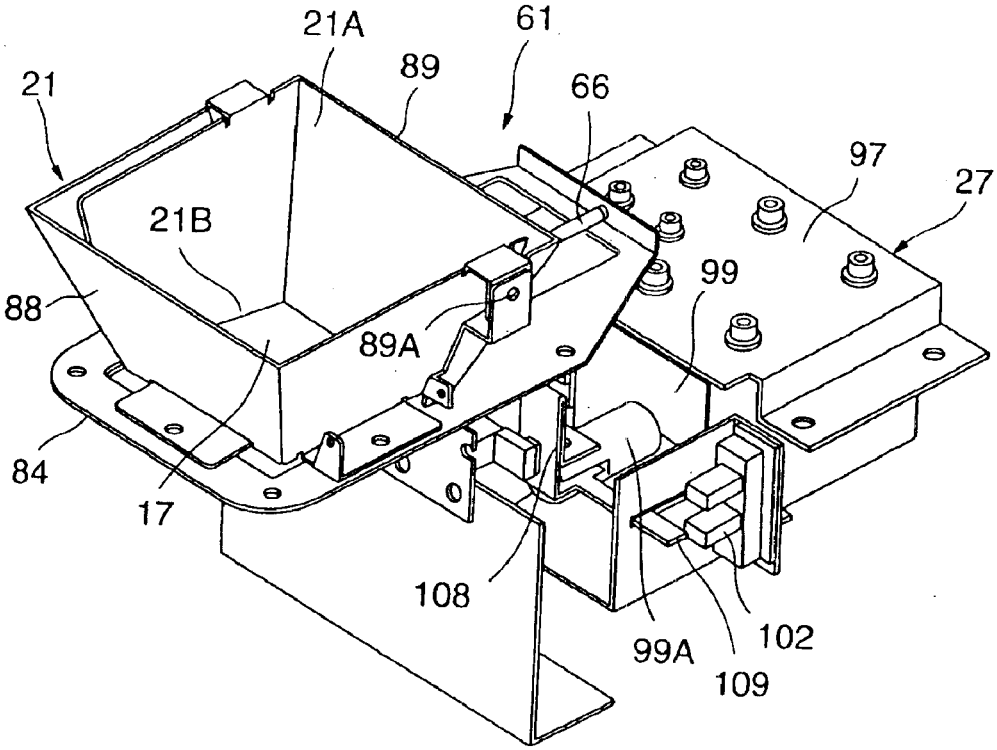
FIG. 30 is a perspective view of the holding unit and the solenoid unit of the medication filling apparatus in accordance with the present invention wherein the shutter has been closed.

In a state wherein the power has been turned ON, the shutter 17 of each holding unit 61 closes the outlet 21B of the holding cell 21, and the movable cell 89 narrows the outlet 21B (FIG. 30, FIG. 31, and FIG. 32), and counter values or the like have been reset.

The microcomputer 45 causes the rotating plate 16 to rotate, for example, clockwise in the drawing by the rotating plate motor 16M. If it is detected that the notches 81 and 7.9B have reached the points above the detecting terminals 41A and 41B of the rotational position detecting sensor 41 (detected when both detect light), then the rotating plate 16 is allowed to continue its rotation by 8 degrees in terms of the rotational angle of the rotating plate 16. Thus, the rotating plate 16 is placed in the state illustrated in FIG. 16, and stopped when the notch 79A reaches the point above the detecting terminal 41A.

This state indicates the initial position of the rotating plate 16. Furthermore, the microcomputer 45 recognizes the positions of all the holding units 61 . . . (e.g., ten, from No. 1 through No. 10) from the dispositions of the ten openings 82 . . . (disposed at intervals of 36 degrees in terms of the rotational angle of the rotating plate 16). This terminates the initialization.

Furthermore, the microcomputer 45 stores the positions of the outlets 12 . . . of the tablet cases 7 . . . and the positions of the dispensing ports 51A through 54A of the hoppers 51 through 54 that are correspondingly located thereunder. Based on the information, the microcomputer 45 computes the rotational angle (including 0 degrees) of the rotating plate 16 to move the holding cell 21 of a predetermined holding unit 61 to the location under the dispensing port 51A, 52A, 53A, or 54A of the hopper 51, 52, 53, or 54 correspondingly located under a predetermined tablet case 7.

When an operator types in prescription data into the personal computer according to a medical prescription supplied by a doctor, the personal computer sends a request for the transmission of the data to the medication filling apparatus 1. When the microcomputer 45 of the medication filing apparatus 1 receives the request for the transmission of the data from the personal computer in step S1 by the sending and receiving means 46, it determines in step S2 whether the holding cells 21 of all the holding units 61 . . . of the rotating plate 16 have been filled up with medications, and if they have been filled up, then it returns to step S1 and stands by.

If all the holding cells 21 . . . are found in step S2 that they have not been filled up, then the microcomputer 45 returns a response in step S3 to tell the personal computer that it is waiting for data, and reads in the prescription data received from the personal computer in response. Then, based on the prescription data, the microcomputer 45 recognizes the position of the tablet case 7 into which the medications of the type specified by the prescription data are to be put.

Next, the microcomputer 45 recognizes in step S4 an empty holding cell 21 (a holding unit 61) and its position. If the holding cell 21 of the holding unit 61 of No. 1 is empty, then microcomputer 45 computes the rotational angle as described above, and drives the rotating plate motor 16M to rotate the rotating plate 16 so as to bring the upper end inlet 21A of the holding cell 21 of the holding unit 61 of No. 1 to the location under the dispensing port 51A, 52A, 53A, or 54A of the hopper 51, 52, 53, or 54 correspondingly located under the outlet 12 of the aforesaid tablet case 7 that has been recognized, thereby adjusting the position of the holding unit 61 and storing the No. also.

If an empty holding cell 21 (a holding unit 61) happens to be under the dispensing port 51A to 54A of the hoppers 51 to 54, then the microcomputer 45 does not cause the rotating plate 16; instead, it stores the No. of this holding cell 21.

Subsequently, the microcomputer 45 rotationally drives, in step S5, the dispensing drum motor 9M of the dispensing counter 8 of the tablet case 7 that has been recognized. This causes the dispensing drum 9 to rotate, and the medications are dropped one by one, as previously mentioned, and the fallen medications are fallen into and received by the hopper 51, 52, 53, or 54 correspondingly located thereunder, and further fallen through the dispensing port 51A, 52A, 53A, or 54A into and received by the holding cell 21 of the holding unit 61.

The number of the dropping medications is counted by the microcomputer 45 by means of the photosensor 13. The microcomputer 45 then determines in step S6 whether the counting has ended, and if the determination result is negative, then the microcomputer 45 returns to step S5 to repeat it. When the number of the fallen medications that is detected by the photosensor 13 coincides with the number of medications based on the prescription data, the microcomputer 45 determines that the counting has terminated, and stops the rotation of the dispensing drum motor 9M, then returns to step S1.

The medications that have fallen into the holding cell 21 (e.g., No. 1) reach the bottom of the holding cell 21. In this state, however, the opening 21B at the bottom end is closed by the shutter 17; therefore, the medications are temporarily retained in the holding cell 21. The microcomputer 45 repeats the operations from the aforesaid step S4 through step S6 on all types of medications specified by the prescription data to accommodate the medications in the holding cells 21 . . . of the separate holding units 61 for respective types.

Up to ten types of medications can be retained in the holding cells 21 of the holding units 61 . . . in the manner as described above. In the embodiment described above, the medications have been accommodated in the holding cells 21 in sequence one type at a time. In the embodiment, however, since the four hoppers 51 through 54 are used, a parallel operation can be also performed, in which four types of medications can be simultaneously fallen from the tablet cases 7 . . . above the hoppers 51 through 54 to simultaneously fill the different holding cells 21 . . . with the four types of medications by assigning the empty holding cells 21 . . . to the dispensing ports 51A through 54A of all the hoppers 51 through 54. With this arrangement, the filling time can be further reduced.

Thus, the positioning in relation to the holding cells 21 is important to simultaneously use all the hoppers 51 through 54 in parallel. Hence, in order to accomplish accurate positioning, when the dispensing ports 51A through 54A of the four hoppers 51 through 54 are disposed at intervals of 90 degrees in relation to the rotational center 16A, the holding cells 21 must be disposed at intervals of 90 degrees also; therefore, the holding units 61 of a quantity of the multiples of 4 are to be disposed at equal intervals.

Meanwhile, the operator pastes a bar code label on which a bar code indicating one type of medications specified by the prescription data has been printed to the side surface of a predetermined container V (e.g., a bottle). When the container V is inserted in the filling section 5A of the medication filling apparatus 1, the bar code of the bar code label is read by the bar code reader 42.

The microcomputer 45 determines in step S7 in FIG. 39 whether the bar code (the type of medications) that has been read by the bar code reader 42 has been read in. If the bar code has been read in, then the microcomputer 45 proceeds to step S8 wherein it determines whether the medications of this particular type have been accommodated in the holding cell 21 (the No. of this holding unit 61 has been stored as mentioned above). If the medications of this particular type have not yet been accommodated, then the microcomputer 45 returns to step S7 wherein it stands by.

When the medications of the particular type have been accommodated in the holding cell 21 of the holding unit 61 in the foregoing step S6, the microcomputer 45 proceeds from step S8 to step S9 wherein it selects the holding unit 61 in which the particular medications have been accommodated from the stored No., and drives the rotating plate motor 16M so as to rotate the rotating plate 16. Furthermore, based on the rotational step of the motor and the notch 79 detected by the rotational position detecting sensor 41, the microcomputer 45 causes the holding unit 61 to be positioned at the locations where the chute 6 at the front center of the base plate 24, and the solenoid unit 27 are positioned.

In this state, the driving plates 106 and 108 of the solenoid unit 27 are positioned in front of the operating plates 92 and 94, respectively, of the holding unit 61, as shown in FIG. 26. Next, the microcomputer 45 energizes the cell solenoid 98 and the shutter solenoid 99 to move the movable cell 89 to open the outlet 21B and also open the shutter 17 in step S10.

The movement of the movable cell 89 and the opening of the shutter 17 are detected by the cell opening sensor 101 and the shutter opening sensor 102 by the retraction of the sensor plates 107 and 109, and input to the microcomputer 45. The opening of the shutter 17 causes the medications in the holding cell 21 to fall into the chute 6 from the outlet 21B at the bottom end. At this time, the outlet 6A of the chute 6 is closed by the cover 26, so that the medications are retained in the chute 6.

After a predetermined period of time from the energization, the microcomputer 45 deenergizes the cell solenoid 98 and the shutter solenoid 99, so that the movable cell 89 is reset by being moved by the spring 91 in the direction for narrowing the outlet 21B. The shutter 17 is also circularly moved by the spring 96 to close the outlet 21B again (horizontal state).

The medications fallen into the holding cell 21 from the hoppers 51 to 54 are packed in a plurality of layers, and form a so-called bridge in the holding cell 21, which would lead to a danger in that only the medications at the bottom fall when the shutter 17 is opened. However, the movable cell 89 is moved to open the outlet 21B, so that the bridge is collapsed, making it possible to fall the medications into the chute 6 securely and quickly.

The medications drop into the chute 6 as described above, and the chute 6 is formed to be thick so as to provide an adequate capacity for storing medications. In addition, the chute 6 is a transparent pipe for a pharmacist to know that the medications are ready, so that he or she can set the mouth of the container V under the outlet 6A of the chute 6 in this state and manually open the cover 26 to fill the bottle with the medications of the appropriate type from the chute 6. The opening and closing operations of the cover 26 is detected by the chute sensor 116 and output to the microcomputer 45 (step S11).

As mentioned above, the system is adopted in which the holding unit 61 formed of the holding cell 21 and the shutter 17 combined into one piece is mounted on the rotating plate 16, and secured using the snap type fixtures 100, permitting the installation to be performed with great ease. Moreover, the solenoid unit 27 equipped with the solenoids 99 and 98 for actuating the movable cell 89 and the shutter 17 is provided so that it does not interfere with the motion of the holding units 61 when the rotating plate 16 rotates, and actuates the one aligned to the chute 6. Hence, only one solenoid unit 27 is required, enabling a marked reduction in the number of components to be achieved, compared with a case where each holding unit 61 is provided with a solenoid.

If the microcomputer 45 detects that the upper door 4 or the lower door 5 has been opened, by means of the upper door sensor 117 or the lower door sensor 118, then it interrupts the above dispensing operation. The microcomputer 45 resumes the dispensing operation from the moment the door is closed.

Furthermore, if the microcomputer 45 detects, by means of the micro switch 76, that any of the hoppers 51 through 54 has not been installed, then it inhibits the dispensing operation, and provides an alarm display to that effect on the display device 47.

Furthermore, if the travel of the movable cell 89 cannot be detected by the cell opening sensor 101, or if the release of the shutter 17 cannot be detected by the shutter opening sensor 102, or if the closing of the shutter 17 cannot be detected by the shutter closing sensor 103 (light is not reflected) in the above dispensing operation, then the dispensing operation is also inhibited, and an alarm display is provided on the display device 47.

In addition, if the opening or closing of the cover 26 is not detected by the chute sensor 116, then at least the release of the shutter 17 is inhibited. This prevents an inconvenience in that, while medications are still retained in the chute 6, another dosage of medications is dropped into the chute 6.

Thus, according to the present invention, medications are dispensed by the microcomputer 45 from the tablet cases 7 accommodating the medications of respective types, and the medications dispensed from the tablet cases 7 are received by the plurality of hoppers 51 through 54 provided side by side thereunder. Hence, the vertical dimension of the apparatus can be reduced while maintaining the tilt angles of the hoppers 51 through 54 that allow the medications to fall.

Furthermore, the microcomputer 45 rotationally moves the holding unit 61 to adjust its position thereby to align the upper end inlet 21A of the holding cell 21 to the dispensing port 51A to 54A of the hoppers 51 to 54 that receive the dispensed medications; hence, the medications fallen from the tablet case 7 are temporarily accommodated in a predetermined holding cell 21. Then, to charge the medications in the container V, the holding unit 61 is rotationally moved to align the outlet 21B to the chute 6, the movable cell 89 is moved, and the shutter 17 is-opened. Hence, the medications in the holding cell 21 smoothly enter into the chute 6 from the lower end outlet 21B and are guided and charged into the container V.

Accordingly, it is possible to charge the medications specified among a plurality of types in respective containers V by the chute 6 at a single location, leading to markedly improved workability. Furthermore, the operation has been realized in which the holding unit 61 is rotationally moved to match its upper end inlet 21A of the holding cell 21 to the dispensing port 51A to 54A of the hopper 51 to 54 and to align the lower end outlet 21B of the holding cell 21 to the chute 6. Therefore, the time required for charging can be considerably shortened, so that the waiting time before the medications are supplied to patients or the like can be further shortened, permitting improved service to be achieved.

Moreover, in a case where a plurality of types of medications are charged in succession, for example, the medications can be respectively accommodated in a plurality of holding cells 21 . . . ; therefore, parallel processing can be smoothly performed. In particular, mixing of medications can be securely prevented as long as the positioning of the hoppers 51 through 54 and the holding cells 21 are accurately performed. This obviates the need for strictly controlling the clearance or the like between a drive component and a peripheral component thereof, allowing a simpler structure and reduced production cost to be achieved, as compared with a prior art.

Furthermore, since the cover 26 that can be opened and closed is provided at the outlet 6A of the chute 6, the medications can be retained in the chute 6 until an operator opens the cover 26 after the medications have been dispensed into the chute 6 from the holding cell 21 by opening the shutter 17. Thus, the operation for filling the containers V can be performed further reliably and easily.

In the embodiment, the descriptions have been given of the construction where the operations are performed according to the prescription data from a host computer; however, the present invention is not limited thereto. The present invention may be also effectively applied to a standalone operation method wherein prescription data is input using the key switch 43.

Furthermore, in the embodiment, the medications have been take out from a single tablet case 7; however, the present application is not limited thereto. As previously mentioned, the same type of medications may be accommodated in two or more tablet cases 7 . . . positioned above the same hoppers 51 through 54, and the medications may be simultaneously dropped from these tablet cases 7 . . . In this case, the microcomputer 45 rotates the dispensing drum motors 9M associated with the plural tablet cases 7 . . . to count the number of tablets by the signals from the photosensors 13 associated with the plural tablet cases 7 . . . In this case, to prevent simultaneous dropping, the rotation of the dispensing drum motors 9M associated with the plural tablet cases 7 . . . is controlled to shift the dropping timings of the medications of the plural tablet cases 7 . . . .

Furthermore, in the embodiment, the container V is not limited to a bottle; the medications may alternatively be charged in a packaging bag composed of a resin, paper, or the like as the container.

INDUSTRIAL APPLICABILITY

Thus, according to the present invention described in detail, medications are dispensed from tablet cases accommodating the medications of respective types, and the medications dispensed from the tablet cases are received by a plurality of hoppers provided side by side thereunder. Hence, the vertical dimension of the apparatus can be reduced while maintaining the tilt angles of the hoppers that allow the medications to fall.

In particular, since the hoppers are detachably installed to retaining members, the ease of the installation and the ease of the maintenance, such as cleaning, of the hoppers to which chips or dust of medications are prone to stick can be significantly improved, thus making it possible to effectively prevent an inconvenience in that the dust or chips of other medications are mixed in.

According to the present invention, in addition to the above, the hopper detecting means are provided for detecting that the hoppers have been installed to the retaining members. Therefore, when the hoppers are removed for maintenance or the like, whether the hoppers have been reinstalled or not can be detected by the hopper detecting means. Thus, if there is a possibility of erroneous charging with the hoppers removed, then the operation of the apparatus, for example, is inhibited or an alarm is issued thus making it possible to avoid such an inconvenience.

According to the present invention, in addition to the above, a height adjusting mechanism for adjusting the height of the outlet of each hopper is provided. Hence, the clearance between the dispensing port of each hopper and the charging means can be adjusted to an optimum value, permitting the prevention of an inconvenience in which the medications discharged from the dispensing ports jump out of the charging means. Moreover, if, for example, the charging means is constructed of a movable member, then it is also possible to avoid an inconvenience in which the hoppers interfere with the operation of the charging means.

According to the present invention, medications are dispensed from the tablet cases accommodating the medications of respective types, and the medications dispensed from the tablets cases are received by the plurality of hoppers arranged thereunder side by side. Hence, the vertical dimension of the apparatus can be reduced while maintaining the tilt angles of the hoppers that allow the medications to fall.

In particular, since each hopper is provided with the vertical wall for partitioning the interior thereof that is installed in a standing manner, it is possible to quickly end an inconvenience in which the medications that have fallen into the hoppers jump around in the hoppers. This allows the medications that have fallen into the hoppers to be quickly retained and stored onto the bottoms in the hoppers, permitting a reduction in the time required for charging medications.

According to the present invention, medications are dispensed by a controller from the tablet cases accommodating the medications of respective types, and the medications dispensed from the tablets cases are received by the plurality of hoppers arranged thereunder side by side. Hence, the vertical dimension of the apparatus can be reduced while maintaining the tilt angles of the hoppers that allow the medications to fall.

In particular, each hopper is provided with an anti-spilling wall that extends outward from the dispensing port and is installed over the full periphery of the dispensing port. Hence, even if a medication that has been dispensed from the dispensing port of each hopper and entered the charging means bounces and attempts to jump out through the clearance between the dispensing port of the hopper and the charging means, the medication can be bounced back toward the charging means by the anti-spilling wall. This makes it possible to securely prevent such an inconvenience in which medications that have come out from the dispensing ports jump out of the charging means.

According to the present invention, medications are dispensed from the tablet cases accommodating the medications of respective types, and the medications dispensed from the tablets cases are received by the plurality of hoppers arranged thereunder side by side. Hence, the vertical dimension of the apparatus can be reduced while maintaining the tilt angles of the hoppers that allow the medications to fall.

Furthermore, the holding cell is rotationally moved to adjust its position thereby to align the upper end inlet of the holding cell to the dispensing port of the hopper that receives the dispensed medications; hence, the medications that have fallen from the tablet case are temporarily accommodated in a predetermined holding cell. To charge the medications in a container, the holding cell is rotationally moved to align its outlet to the charging means before the shutter is opened. Therefore, the medications in the holding cell are guided and charged into the container from the lower end outlet by the charging means.

Accordingly, it is possible to charge the medications specified among a plurality of types in respective containers by the charging means at a single location, leading to markedly improved workability. Furthermore, the operation has been realized in which the holding cells are rotationally moved to match their upper end inlets to the dispensing ports of the hoppers and to align the lower end outlets of the holding cells to the charging means. Therefore, the time required for charging can be considerably shortened, so that the waiting time before the medications are supplied to patients can be further shortened, permitting improved service to be achieved.

Moreover, in a case where a plurality of types of medications are charged in succession, for example, the medications can be respectively accommodated in a plurality of holding cells; therefore, parallel processing can be smoothly performed. In particular, mixing of medications can be securely prevented as long as the positioning of the hoppers and the holding cells are accurately performed. This obviates the need for strictly controlling the clearance or the like between a drive component and a peripheral component thereof, allowing a simpler structure and reduced production cost to be achieved, as compared with a prior art.

In particular, in the present invention, the holding cells are constructed by the fixed cells and the movable cells installed so that they can move in the direction for opening the outlets in relation to the fixed cells, and the movable cells are moved in the direction for opening the outlets by the movable cell driving means when opening the shutters. Hence, even if medications are stacked and stuck in the holding cells, the stuck medications can be collapsed by moving the movable cells, thus permitting the medications to smoothly fall into the charging means. Thus, the time required for charging can be further shortened and a reliable charging operation can be realized.

According to the present invention, in addition to the above, the movable cell operation detecting means for detecting the operation of the movable cells is provided. Therefore, if a problem arises in the movement of the movable cells due to a failure of the movable cell driving means or other member, then it will be possible to detect it, and to inhibit, for example, the operation of the apparatus or to issue an alarm.

According to the present invention, in addition to the above, the movable cell driving means is disposed such that it disengageably engages the movable cell of the holding cell that matches the charging means, without interfering with the rotational movement of the holding cell. Hence, only a single movable cell driving means for moving the movable cells of a plurality of holding cells is required, permitting a marked reduction in the number of components, as compared with a case where each holding cell is provided with a driving means.

According to the present invention, medications are dispensed from the tablet cases accommodating the medications of respective types, and the medications dispensed from the tablets cases are received by the plurality of hoppers arranged thereunder side by side. Hence, the vertical dimension of the apparatus can be reduced while maintaining the tilt angles of the hoppers that allow the medications to fall.

Furthermore, according to the present invention, the holding cell is rotationally moved to adjust its position thereby to align the upper end inlet of the holding cell to the dispensing port of the hopper that receives the dispensed medications; hence, the medications that have fallen from the tablet case are temporarily accommodated in a predetermined holding cell. To charge the medications in a container, the holding cell is rotationally moved to align its outlet to the charging means before the shutter is opened. Therefore, the medications in the holding cell are guided and charged into the container from the lower end outlet by the charging means.

Accordingly, it is possible to charge the medications specified among a plurality of types in respective containers by the charging means at a single location, leading to markedly improved workability. Furthermore, the operation has been realized in which the holding cells are rotationally moved to match their upper end inlets to the dispensing ports of the hoppers and to align the lower end outlets of the holding cells to the charging means. Therefore, the time required for charging can be considerably shortened, so that the waiting time before the medications are supplied to patients can be further shortened, permitting improved service to be achieved.

Moreover, in a case where a plurality of types of medications are charged in succession, for example, the medications can be respectively accommodated in a plurality of holding cells; therefore, parallel processing can be smoothly performed. In particular, mixing of medications can be securely prevented as long as the positioning of the hoppers and the holding cells are accurately performed. This obviates the need for strictly controlling the clearance or the like between a drive component and a peripheral component thereof, allowing a simpler structure and reduced production cost to be achieved, as compared with a prior art.

In particular, according to the present invention, the holding unit is constructed by a holding cell and a shutter, and a plurality of the holding units are installed on a rotating plate that rotates below the hoppers. Therefore, the time and labor required for installing the holding cells and shutters can be reduced, permitting marked improvement in the assemblability to be achieved.

According to the present invention, in addition to the above, the shutter driving means for opening and closing the shutters is disposed such that it disengageably engages the shutter of the holding unit with its holding cell aligned to the charging means, without interfering with the rotational movement of the holding unit by the rotation of the rotating plate. Hence, only a single shutter driving means for opening and closing the shutters of a plurality of holding units is required, permitting a marked reduction in the number of components, as compared with a case where each holding unit is provided with a driving means.

According to the present invention, in addition to the above, the shutter opening/closing detecting means for detecting the opening and closing of the shutters is provided. Hence, if an opening or closing failure of the shutters takes place due to a failure of the shutter driving means or other components, it is possible to detect the failure and, for example, to inhibit the operation of the apparatus or to issue an alarm.

What is claimed is:

1. A medication filling apparatus comprising a plurality of tablet cases for accommodating medications of respective types, a plurality of hoppers provided side by side below the respective tablet cases arranged to receive the medications dispensed therefrom, dispensing ports respectively formed at the bottommost portions of the hoppers, a plurality of holding cells that are disposed below the hoppers and are rotationally moved on circumferences where the dispensing ports of the hoppers exist, shutters for opening and closing lower end outlets of the holding cells, and charging means for guiding the medications dispensed from the holding cell to a predetermined container and for charging the medications wherein, when a medication is dispensed from a tablet case, a holding cell is rotationally moved to adjust its position thereby to align an upper end inlet of the holding cell to the dispensing port of the hopper that receives the dispensed medication so as to accommodate the medication falling from the tablet case in a predetermined holding cell, and when filling a container, the holding cell is rotationally moved to align its outlet to the charging means before a shutter is opened, wherein the holding cell is constructed by a fixed cell and a movable cell installed such that it can move in a direction for opening the outlet in relation to the fixed cell, and the movable cell is moved in a direction for opening the outlet by movable cell driving means when opening the shutter.

2. A medication filling apparatus according to claim 1, further comprising movable cell operation detecting means for detecting the operation of the movable cell.

3. A medication filling apparatus according to claim 1 or 2, wherein the movable cell driving means is disposed such that it disengageably engages the movable cell of the holding cell that matches the charging means, without interfering with the rotational movement of the holding cell.

4. A medication filling apparatus comprising a plurality of tablet cases for accommodating medications of respective types, a plurality of hoppers provided side by side below the respective tablet cases arranged to receive the medications dispensed therefrom, dispensing ports respectively formed at the bottommost portions of the hoppers, a plurality of holding cells that are disposed below the hoppers and are rotationally moved on circumferences where the dispensing ports of the hoppers exist, shutters for opening and closing lower end outlets of the holding cells, and charging means for guiding the medications dispensed from the holding cells to a predetermined container and for charging the medications, wherein, when a medication is dispensed from a tablet case, a holding cell is rotationally moved to adjust its position thereby to align an upper end inlet of the holding cell to the dispensing port of the hopper that receives the dispensed medication so as to accommodate the medication falling from the tablet case in a predetermined holding cell, and when filling a container, the holding cell is rotationally moved to align its outlet to the charging means before a shutter is opened, wherein a holding unit is constructed by the holding cell and the shutter, and a plurality of the holding units are installed on a rotating plate that rotates below the hoppers.

* * * * *